US010476132B2

(12) United States Patent
Kosaka et al.

(10) Patent No.: US 10,476,132 B2
(45) Date of Patent: Nov. 12, 2019

(54) ANTENNA, ANTENNA ARRAY, AND RADIO COMMUNICATION APPARATUS

(71) Applicant: NEC Corporation, Tokyo (JP)

(72) Inventors: Keishi Kosaka, Tokyo (JP); Hiroshi Toyao, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 15/300,467

(22) PCT Filed: Nov. 14, 2014

(86) PCT No.: PCT/JP2014/005722
§ 371 (c)(1),
(2) Date: Sep. 29, 2016

(87) PCT Pub. No.: WO2015/151139
PCT Pub. Date: Oct. 8, 2015

(65) Prior Publication Data

US 2017/0125885 A1 May 4, 2017

(30) Foreign Application Priority Data

Mar. 31, 2014 (JP) ..... 2014-073195

(51) Int. Cl.
*H01Q 1/24* (2006.01)
*H01Q 1/36* (2006.01)
(Continued)

(52) U.S. Cl.
CPC ..... *H01Q 1/24* (2013.01); *H01Q 1/36* (2013.01); *H01Q 9/065* (2013.01); *H01Q 9/26* (2013.01);
(Continued)

(58) Field of Classification Search
CPC ..... H01Q 1/24; H01Q 21/00; H01Q 1/36; H01Q 9/065; H01Q 15/14; H01Q 9/285;
(Continued)

(56) References Cited

U.S. PATENT DOCUMENTS

2002/0190909 A1* 12/2002 Yamamoto ..... H01Q 9/42 343/742
2012/0169552 A1* 7/2012 Lee ..... H01Q 9/285 343/727
(Continued)

FOREIGN PATENT DOCUMENTS

JP 2005-347958 A 12/2005
JP 2006-352293 A 12/2006
(Continued)

OTHER PUBLICATIONS

International Search Report corresponding to PCT/JP2014/005722, dated Jan. 6, 2015, 1 page.
(Continued)

*Primary Examiner* — Hai V Tran
*Assistant Examiner* — Michael M Bouizza
(74) *Attorney, Agent, or Firm* — Wilmer Cutler Pickering Hale and Dorr LLP

(57) ABSTRACT

A dual-polarized antenna in which two antenna elements are highly integrated and the size of the whole antenna is reduced while suppressing coupling between the two antenna elements without having the two antenna elements overlap each other is provided. An antenna (10) includes a conductive reflector (101) and two antenna elements (102, 103) (antenna elements) that are arranged to be spaced apart from each other. As shown in FIG. 3, in a projected view on the conductive reflector (101), longitudinal directions of the two antenna elements (102, 103) are substantially orthogonal to each other. One of the end parts (110) of the antenna
(Continued)

element (103) in the longitudinal direction is positioned at an approximate center (109) (part around the center) of the antenna element (102) in the longitudinal direction.

10 Claims, 28 Drawing Sheets

(51) Int. Cl.

| | |
|---|---|
| ***H01Q 15/14*** | (2006.01) |
| ***H01Q 21/00*** | (2006.01) |
| ***H01Q 9/06*** | (2006.01) |
| ***H01Q 21/06*** | (2006.01) |
| ***H01Q 21/24*** | (2006.01) |
| ***H01Q 21/28*** | (2006.01) |
| ***H01Q 9/26*** | (2006.01) |

(52) U.S. Cl.
CPC ..... *H01Q 15/14* (2013.01); *H01Q 21/00* (2013.01); *H01Q 21/06* (2013.01); *H01Q 21/24* (2013.01); *H01Q 21/28* (2013.01)

(58) Field of Classification Search
CPC ..... H01Q 9/26; H01Q 21/28; H01Q 21/24; H01Q 21/06
See application file for complete search history.

(56) References Cited

U.S. PATENT DOCUMENTS

| | | | | |
|---|---|---|---|---|
| 2013/0249753 | A1 | 9/2013 | Asanuma et al. | |
| 2014/0203993 | A1* | 7/2014 | Toyao ..... | H01Q 13/10 343/867 |

FOREIGN PATENT DOCUMENTS

| | | | |
|---|---|---|---|
| JP | 2007-060062 | A | 3/2007 |
| JP | 4073130 | B2 | 4/2008 |
| JP | 2009-124403 | A | 6/2009 |
| WO | WO-2013/027824 | A1 | 2/2013 |
| WO | WO-2013/061502 | A1 | 5/2013 |

OTHER PUBLICATIONS

Notification of Reasons for Refusal issued by the Japan Patent Office for Japanese Application No. 2016-511173 dated Aug. 21, 2018 (6 pages).

* cited by examiner

102、103

102、103

ANTENNA, ANTENNA ARRAY, AND RADIO COMMUNICATION APPARATUS

CROSS-REFERENCE TO RELATED APPLICATIONS

This application is a national stage application of International Application No. PCT/JP2014/005722 entitled "ANTENNA, ANTENNA ARRAY, AND RADIO COMMUNICATION APPARATUS," filed on Nov. 14, 2014, which claims the benefit of the priority of Japanese Patent Application No. 2014-073195 filed on Mar. 31, 2014, the disclosures of each of which are hereby incorporated by reference in their entirety.

TECHNICAL FIELD

The present invention relates to an antenna, an antenna array, and a radio communication apparatus.

BACKGROUND ART

In recent years, orthogonal dual-polarized antennas and orthogonal dual-polarized antenna arrays in which multi-input-multi-output (MIMO) communications can be achieved by polarization diversity have been in practical use, for example, as base stations for mobile communications or antenna apparatuses for Wi-Fi communication devices to ensure communication capacity. Most of the orthogonal dual-polarized antennas and the orthogonal dual-polarized antenna arrays are composed of two antenna elements that are arranged to be substantially vertical to each other and an array of the antenna elements. In order to prevent a decrease in the communication capacity, it is required to suppress the coupling between the two antenna elements. While the coupling between the two antenna elements can be suppressed by separating the two antenna elements, it is also required to increase the integration degree of the antenna elements and to reduce the size of the antenna in order to reduce the size of the whole apparatus.

Antennas disclosed in Patent Literature 1, 2, and 3 are examples of the above orthogonal dual-polarized antenna. These antennas have a structure in which two antenna elements (in these examples, dipole antennas) are arranged in a cross shape so that the centers of the respective antenna elements overlap and become orthogonal to each other, whereby it is possible to reduce the size of the whole antenna while suppressing the coupling between the two antenna elements.

CITATION LIST

Patent Literature

[Patent Literature 1] Japanese Patent No. 4073130
[Patent Literature 2] Japanese Unexamined Patent Application Publication No. 2006-352293
[Patent Literature 3] Japanese Unexamined Patent Application Publication No. 2009-124403

SUMMARY OF INVENTION

Technical Problem

When the two antenna elements are arranged in such a way that the centers of the respective antenna elements overlap each other as stated above, however, one antenna element needs to be cut, whereby the structure of the antenna elements becomes complicated and it becomes difficult to manufacture the antenna elements. In addition, since feed lines to the respective antenna elements come close to each other, the coupling between the two antenna elements may be increased due to the electromagnetic coupling via the feed lines.

The present invention aims to provide a dual-polarized antenna in which the integration degree of the antenna elements is increased and the size of the whole antenna is reduced while suppressing the coupling between the two antenna elements without overlapping the two antenna elements.

Solution to Problem

In one aspect of the present invention, an antenna includes: a conductive reflector; and two antenna elements that are arranged to be spaced apart from each other, in which, in a projected view on the conductive reflector, longitudinal directions of the two antenna elements are substantially orthogonal to each other and an end part of one of the two antenna elements in the longitudinal direction is positioned around the center of the other one of the antenna elements in the longitudinal direction.

Advantageous Effects of Invention

According to the present invention, it is possible to provide a dual-polarized antenna in which the integration degree of the antenna elements is increased and the size of the whole antenna is reduced while suppressing the coupling between the two antenna elements without overlapping the two antenna elements.

DESCRIPTION OF EMBODIMENTS

Hereinafter, with reference to the drawings, embodiments of the present invention will be described in detail. Although technically preferred limitation to carry out the present invention is made to the embodiments described below, the scope of the present invention is not limited to the following description.

(First Embodiment)

An antenna 10 according to a first embodiment of the present invention will be described below.

Figure 1:
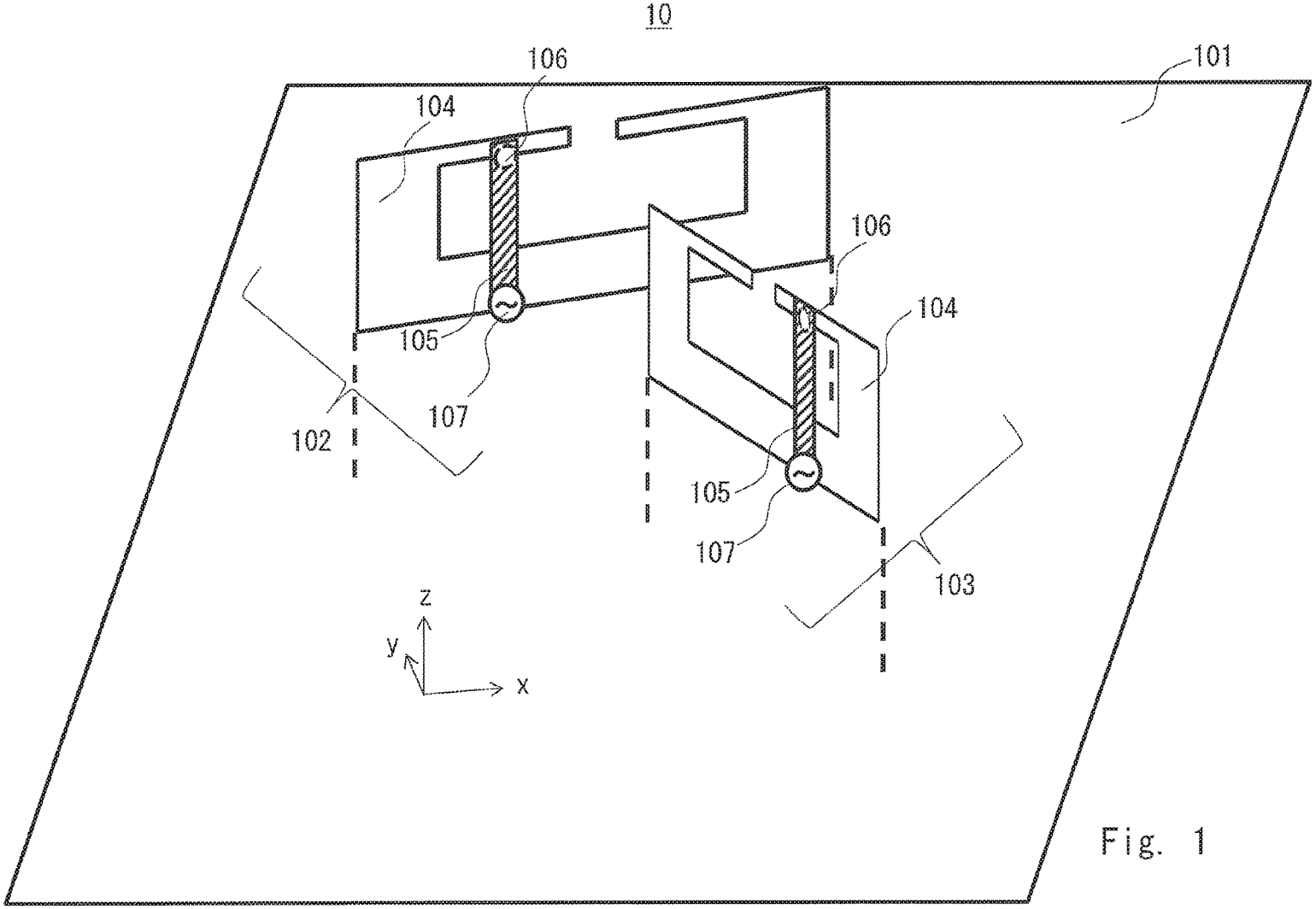
FIG. 1 is a perspective view of an antenna.
Figure 2:
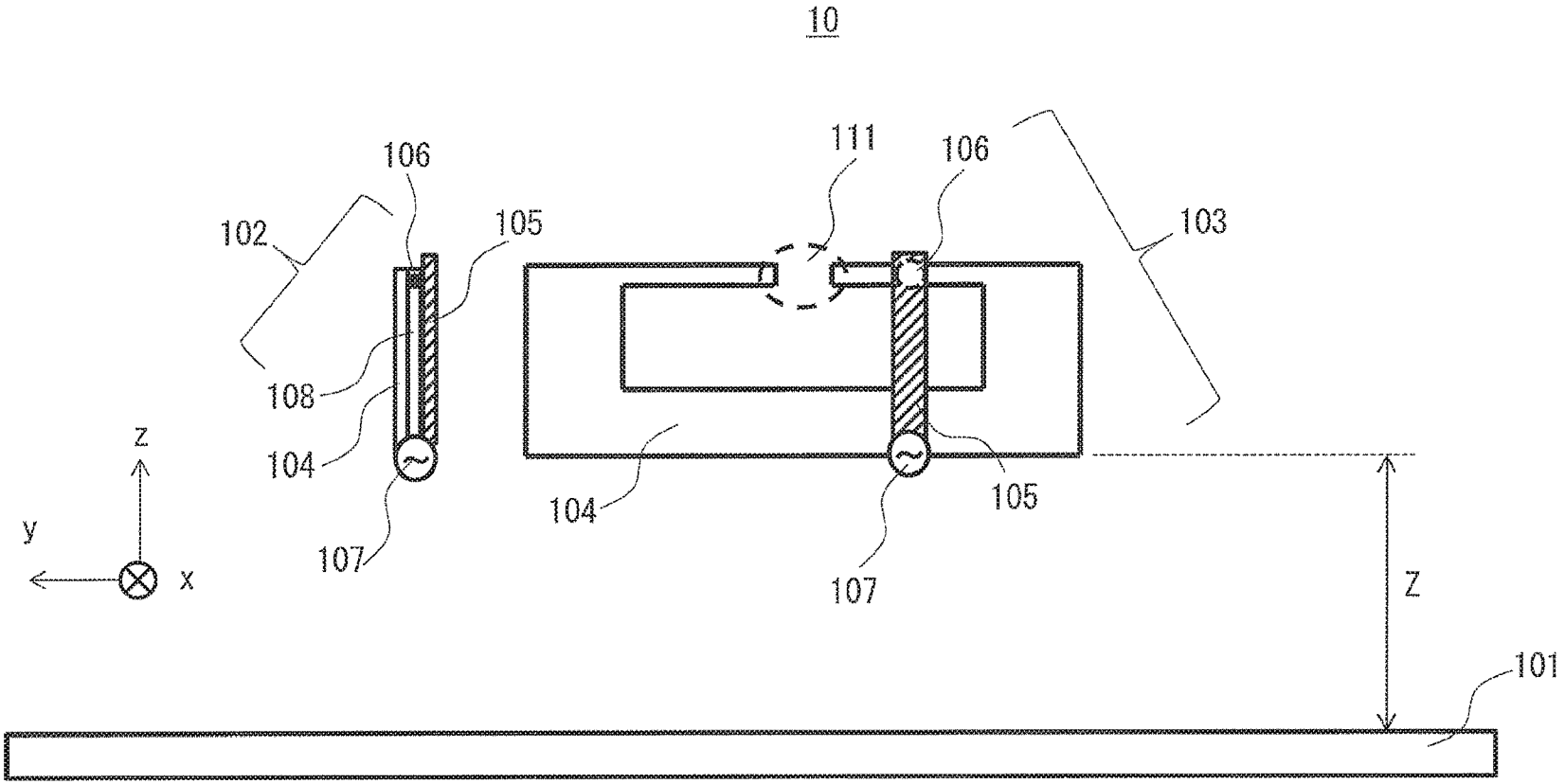
FIG. 2 is a front view of the antenna.
Figure 3:
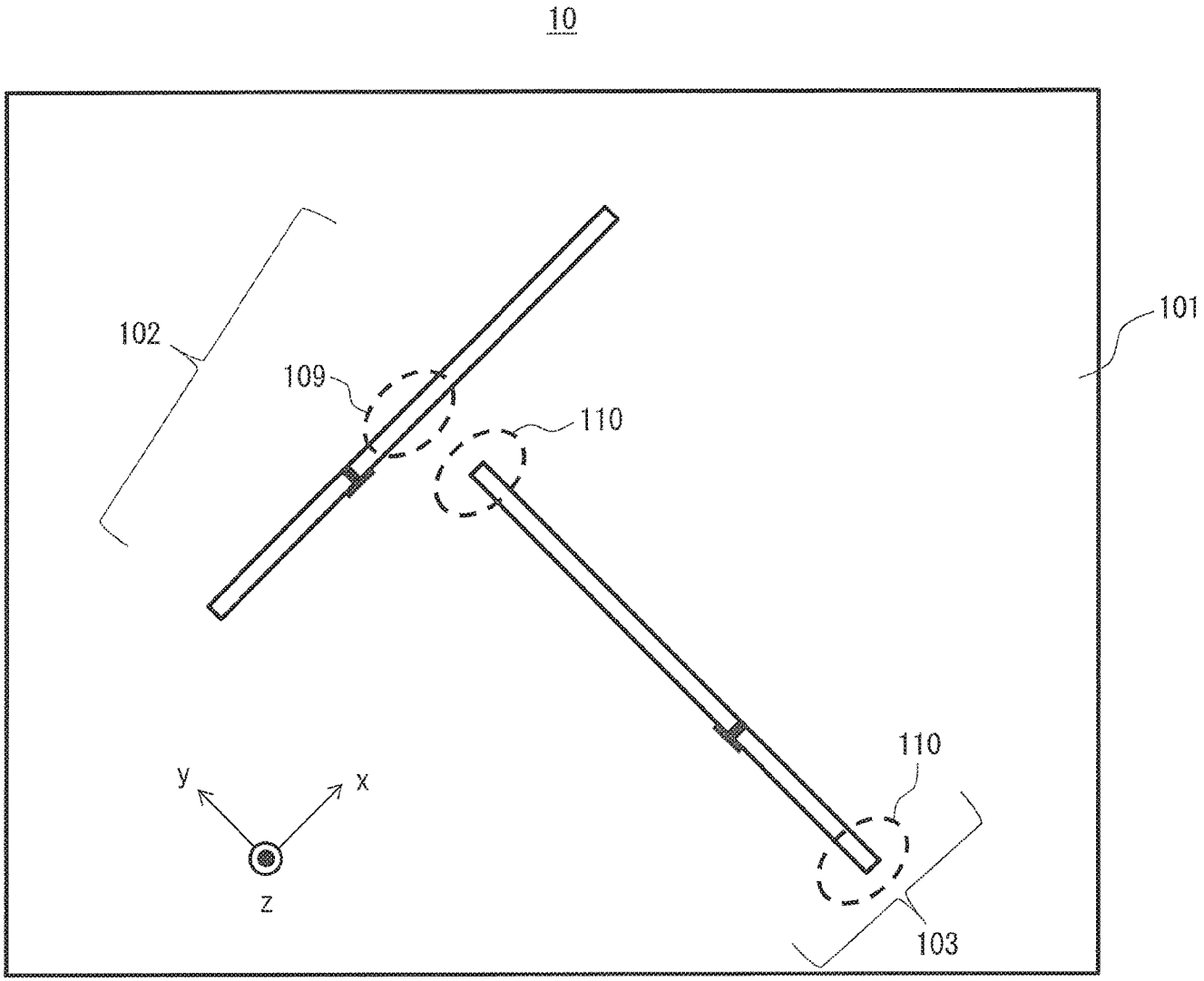
FIG. 3 is a plan view of the antenna.

FIG. 1 is a perspective view of the antenna 10, FIG. 2 is a front view of the antenna 10, and FIG. 3 is a plan view of the antenna 10. In FIGS. 1 and 2, the antenna 10 includes a conductive reflector 101 and two antenna elements 102 and 103 above a surface of the conductive reflector 101. As shown in FIG. 3, in a projected view on the conductive reflector 101, longitudinal directions of the two antenna elements 102 and 103 are substantially orthogonal to each other and an end part 110 of the antenna element 103 in the longitudinal direction (in FIG. 3, y-axis direction) is positioned near an approximate center 109 (part around the center) of the antenna element 102 in the longitudinal direction. The two antenna elements 102 and 103 are arranged so as to be spaced apart from each other.

As shown in FIGS. 1 and 2, the antenna elements 102 and 103 each include, for example, a dielectric layer 108, a C-shaped conductor 104 that is formed on one side of the dielectric layer 108, has a substantially C shape, and serves as a split-ring resonator, a conductor feed line 105 that is formed on the other side of the dielectric layer 108 and is opposed to the C-shaped conductor 104 with an interval therebetween, a conductive via 106 that electrically connects a part on the long side of the C-shaped conductor 104 that is apart from the conductive reflector 101 (z-axis positive direction side) and one end of the conductor feed line 105, and a feeding point 107 capable of electrically exciting a part between the other end of the conductor feed line 105 and the neighboring C-shaped conductor 104.

The dielectric layer 108 may not be shown in the drawings to simplify the description. The dielectric layer 108 may not be shown in the drawings in order to facilitate the understanding of the technique of the present invention.

The conductive reflector 101, the C-shaped conductor 104, the conductor feed line 105, the conductive via 106, and the other conductors are made of metal such as copper, silver, aluminum, or nickel, or other good conductor materials. Further, although the C-shaped conductor 104, the conductor feed line 105, the conductive via 106, and the dielectric layer 108 are typically manufactured in a process for manufacturing a normal substrate such as a printed board or a semiconductor substrate, they may be manufactured by another method. Furthermore, although the conductive via 106 is typically formed by plating a through-hole that is formed on the dielectric layer 108 by a drill, any other method may be used as long as the layers can be electrically connected. The conductive via 106 may be formed by using, for example, a laser via formed by a laser, a copper line or the like.

Further, the dielectric layer 108 may be omitted or the parts of the dielectric layer 108 other than a partial dielectric material support member may be hollow. The feeding point 107 is connected, for example, to a radio communication circuit (not shown) or a transmission line (not shown) that transmits radio signals from the radio communication circuit so that radio communication signals can be transmitted between the radio communication circuit and the antenna 10. Further, while the conductive reflector 101 is typically formed of copper foil bonded to a sheet metal or a dielectric substrate, it may be formed of another material as long as it is conductive.

The antenna 10 described above is appropriately embedded in, for example, radio communication apparatuses such as Wi-Fi and mobile communication base stations as an antenna part.

Figure 4:
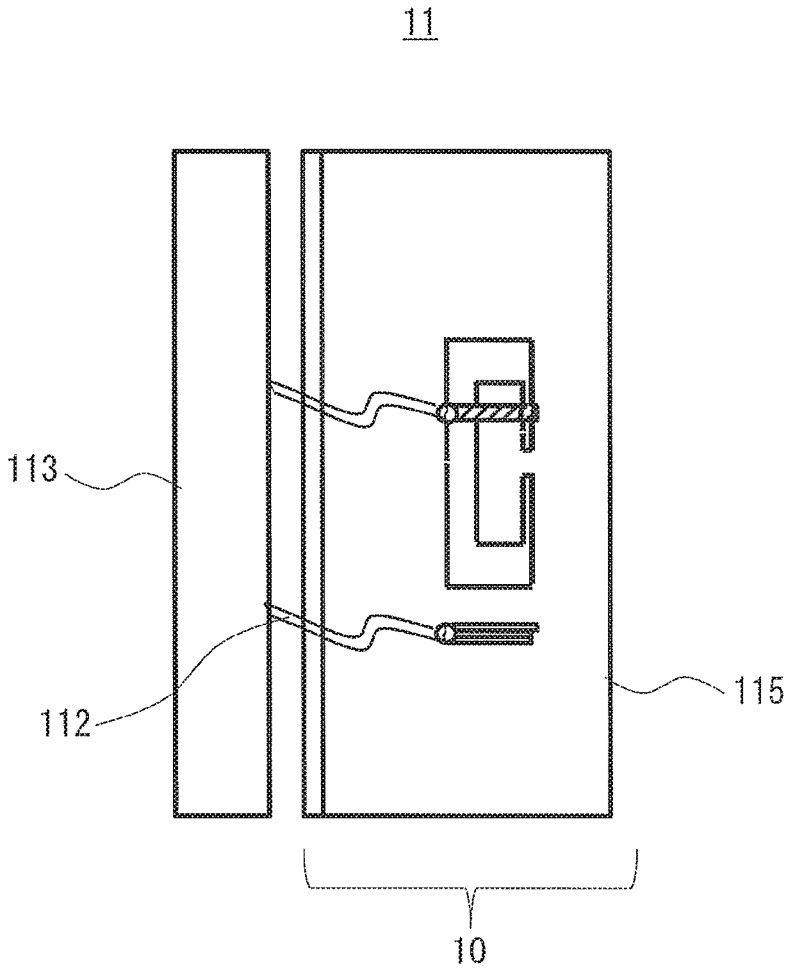
FIG. 4 is a front view of a radio communication apparatus.

FIG. 4 shows a radio communication apparatus 11, which is one example of the radio communication apparatus including the antenna 10. The radio communication apparatus 11 includes the antenna 10, a dielectric radome 115 that mechanically protects the antenna 10, a radio communication circuit 113, and a transmission line 112 that transmits radio signals between an antenna element in the antenna 10 and the radio communication circuit 113.

Figure 5:
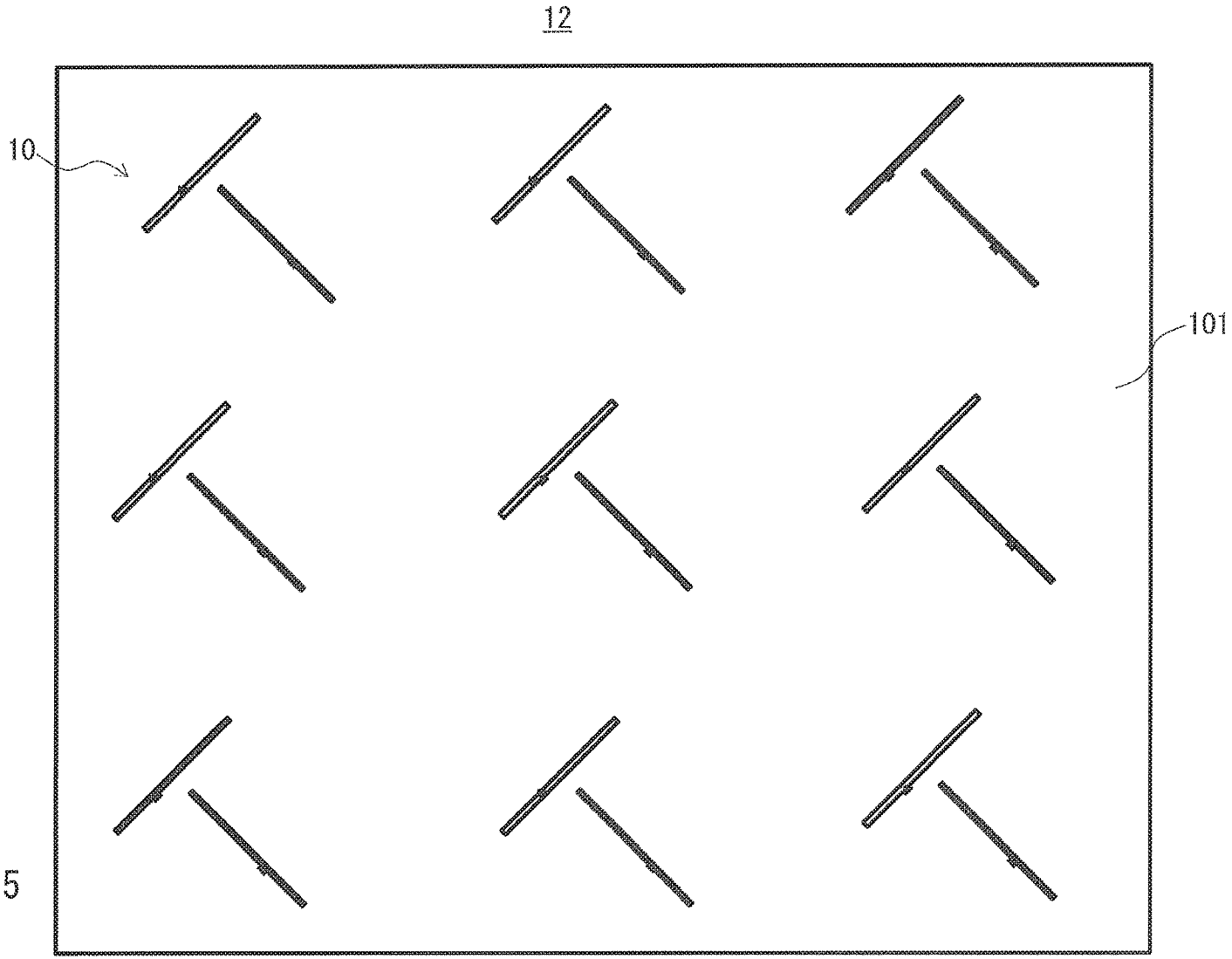
FIG. 5 is a plan view of an antenna array.
Figure 6:
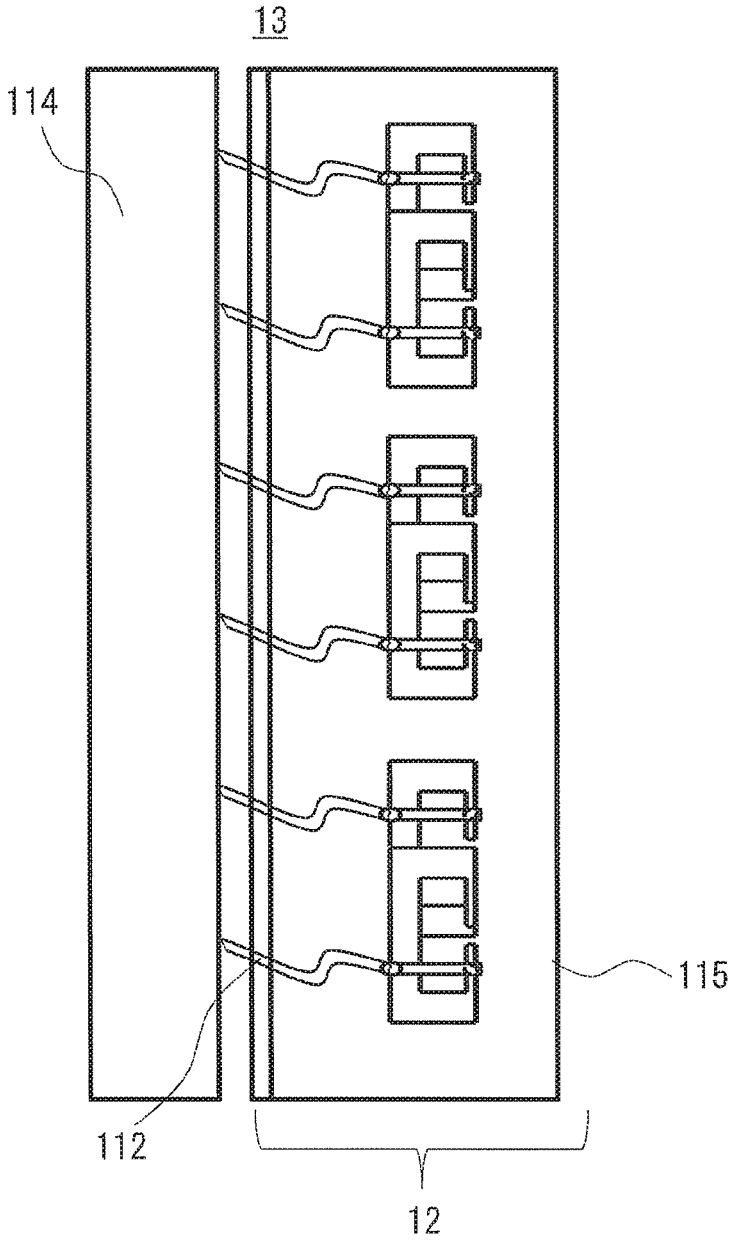
FIG. 6 is a front view of the radio communication apparatus.

Further, FIG. 5 shows an antenna array 12 in which a plurality of antennas 10 are arranged in such a way that they are spaced apart from one another by about ½ of the wavelength of electromagnetic waves of the resonance frequency of the antenna element and FIG. 6 shows a radio communication apparatus 13, which is one example of the radio communication apparatus including the antenna array 12. Instead of providing one conductive reflector 101 for each antenna 10, one conductive reflector 101 in which all the conductive reflectors are connected in the form of a plate is used in the antenna array 12. However, the configuration of the conductive reflector 101 is not limited to this example. Further, when a plurality of antennas 10 are arranged, they are not necessarily arranged at regular intervals and translationally symmetric and may be oriented in various directions and arranged at irregular intervals. The radio communication apparatus 13 includes the antenna array 12, the dielectric radome 115, the transmission line 112, and a radio communication circuit unit 114.

The radio communication apparatus 11 and the radio communication apparatus 13 are used, for example, as the radio communication apparatus or the mobile communication base station, and may further include, for example, a baseband processor that performs baseband processing and the like. Further, beam forming may be performed by controlling input signals to co-polarized antenna elements in the antenna array 12 by the radio communication circuit unit 114 or the like.

The functions and the effects of the embodiment of the present invention will now be described.

The present inventors have conducted a detailed investigation of an electromagnetic field that is generated around the two antenna elements 102 and 103 when the two antenna elements 102 and 103 are electromagnetically resonated and have found that parts around both of the end parts 110 of the two antenna elements 102 and 103 in the longitudinal direction (the longitudinal direction of the antenna element 102 corresponds to the x-axis direction in FIG. 3 and the longitudinal direction of the antenna element 103 corresponds to the y-axis direction in FIG. 3) become electrically open planes, in which the electric field strength is high and the magnetic field strength is low and parts around the approximate centers 109 become electrically short-circuited planes, in which the magnetic field strength is high and the electric field strength is low.

In the antenna 10 according to the present invention, the two antenna elements 102 and 103 do not overlap each other in a cross shape and are arranged to be substantially orthogonal to each other with an interval therebetween so that the approximate center 109 of one antenna element and the end part 110 of the other antenna element in the longitudinal direction become close to each other.

According to the above arrangement, in each of the electric field and the magnetic field, the two antenna elements are orthogonally arranged in such a way that the components that have the high strength do not come close to each other, whereby it is possible to arrange the two antenna elements in such a way that they come close to each other while suppressing the coupling between them. Further, in this case, the distance between the feeding points 107 of both elements increases and there is no region where the elements physically overlap each other in view of the structure of the elements, whereby it is possible to avoid the manufacturing complexity while suppressing the coupling, which is due to the feed parts coming close to each other. However, since the conductors are close to each other in a split part 111 of the C-shaped conductor 104 in FIG. 2, the electric field strength of the split part 111 is high although the split part 111 is at the center of each of the two antenna elements 102 and 103. However, the electric field strength of only a small space between the conductor parts that are opposed to each other becomes high and the electric field strength is abruptly decreased in a part away from the split part 111. Therefore, the fact that the split part 111 has a high electric field strength does not affect the effects of the present invention.

According to the above structure, it is possible to provide a dual-polarized antenna in which antenna elements are highly integrated and the size of the whole antenna is reduced while suppressing coupling between the two antenna elements without having two antenna elements overlap each other and a communication apparatus and a communication system that use the dual-polarized antenna.

More preferably, the aforementioned distance between the approximate center 109 of one antenna element and the end part 110 of the other antenna element, which corresponds to a distance between the antenna element 102 and the antenna element 103, is made about one quarter of the wavelength or smaller when the array antenna is formed for the purpose of suppressing the distance between the plurality of dual-polarized antennas 10 to about the half wavelength of the electromagnetic waves of the frequency to be used.

Figure 7:
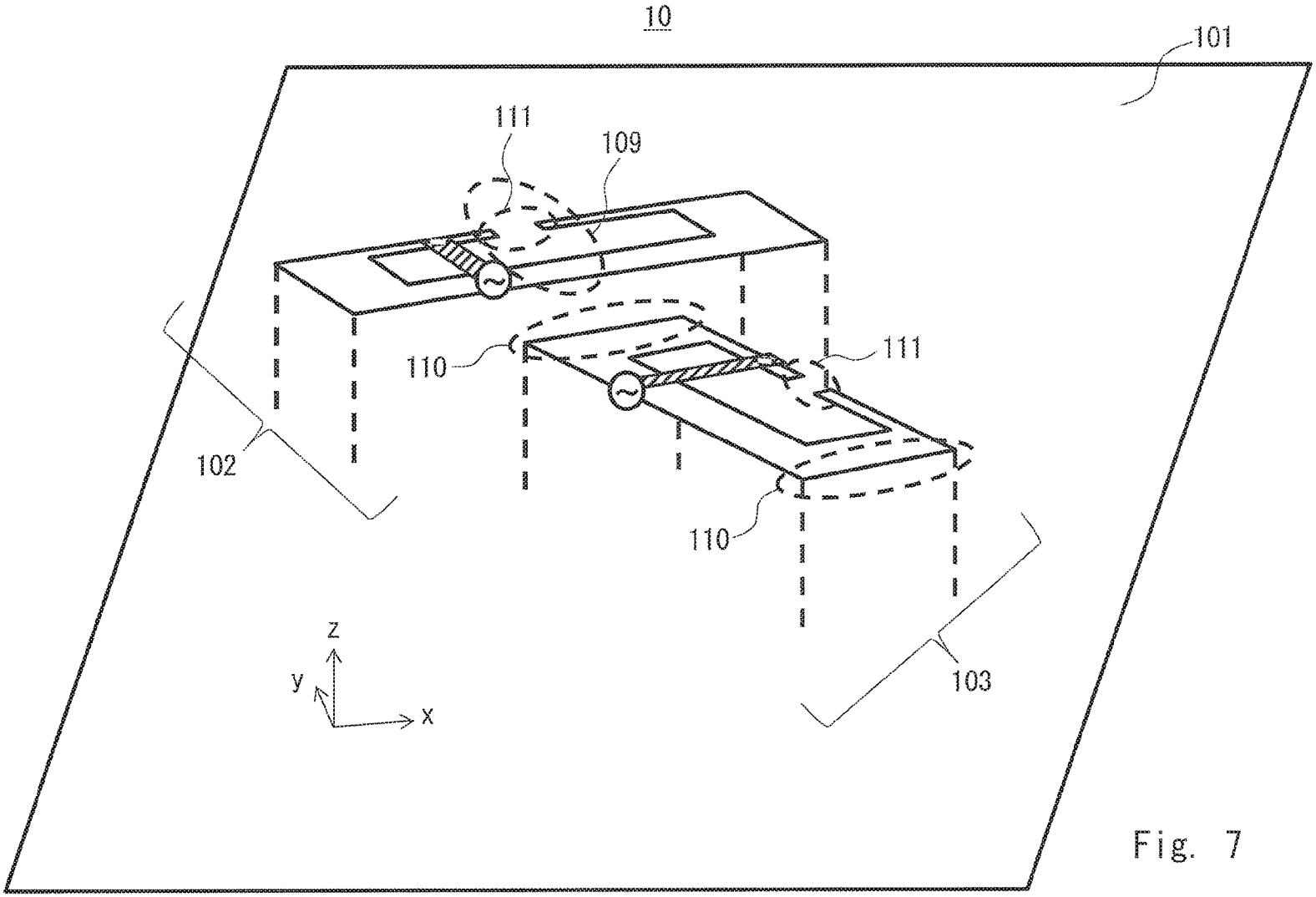
FIG. 7 is a perspective view of a modified example of the antenna.
Figure 33:
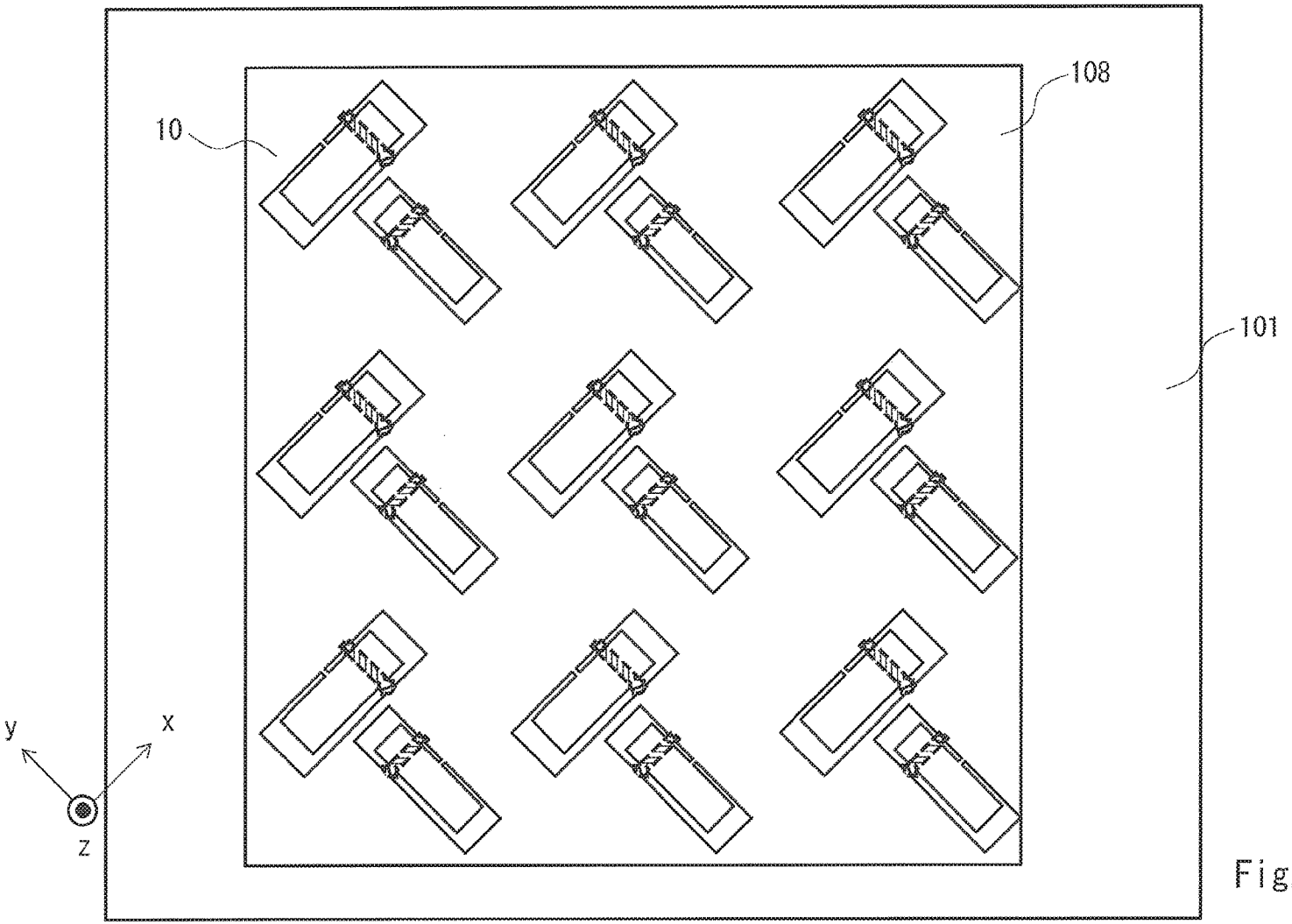
FIG. 33 is a plan view of a modified example of the antenna array.

Further, the two antenna elements 102 and 103 are not necessarily inverted with respect to the conductive reflector 101 as shown in FIGS. 1 and 2 and may be, for example, parallel to the conductive reflector 101 as shown in FIG. 7. When the structure in which the two antenna elements 102 and 103 are made parallel to the conductive reflector 101 is employed, the antenna elements 102 and 103 may be formed in one substrate having a common dielectric layer 108. In addition, when the array antenna in which a plurality of antennas 10 are arranged is formed, the plurality of antennas 10 may be formed in one substrate as shown in FIG. 33. According to the above structure, the number of processes for aligning the plurality of antenna elements can be reduced, which makes the assembling process easier. Further, when the structure in which the two antenna elements 102 and 103 are made parallel to the conductive reflector 101 is employed, in the antenna element that is close to the other antenna element in the approximate center 109 (in FIG. 7, the antenna element 102), the end part of the antenna element 102 in the approximate center 109 which does not include the split part 111 preferably faces toward the antenna element 103 so that the coupling between the antenna elements is reduced. In other words, when the structure in which the two antenna elements 102 and 103 are made parallel to the conductive reflector 101 is employed, the split part 111 of the antenna element 102 opens in a direction away from the antenna element 103 so that the coupling between the antenna elements is reduced.

In addition, the two antenna elements 102 and 103 may not necessarily have the structures shown in FIGS. 1 and 2 and further modifications may be made on the structures thereof.

Figure 8:
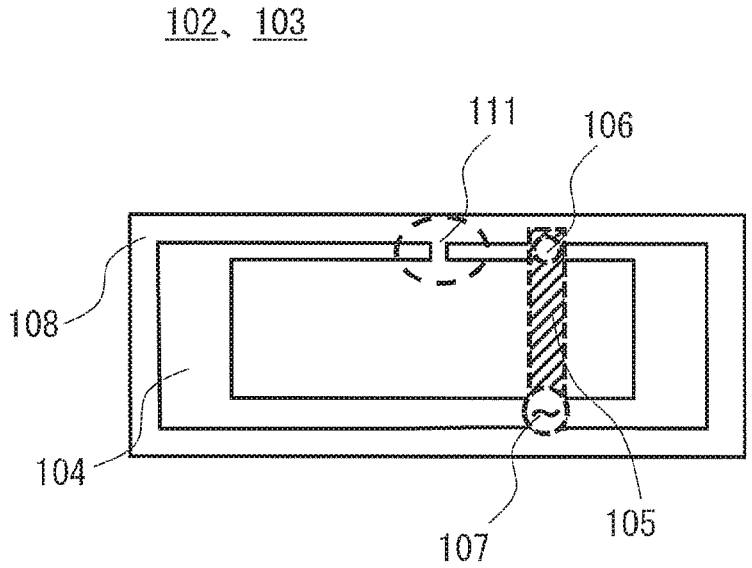
FIG. 8 is a front view of a modified example of an antenna element.
Figure 9:
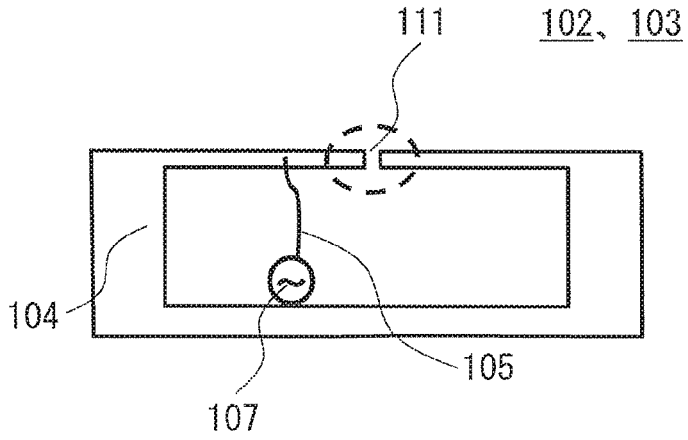
FIG. 9 is a front view of a modified example of the antenna element.
Figure 10:
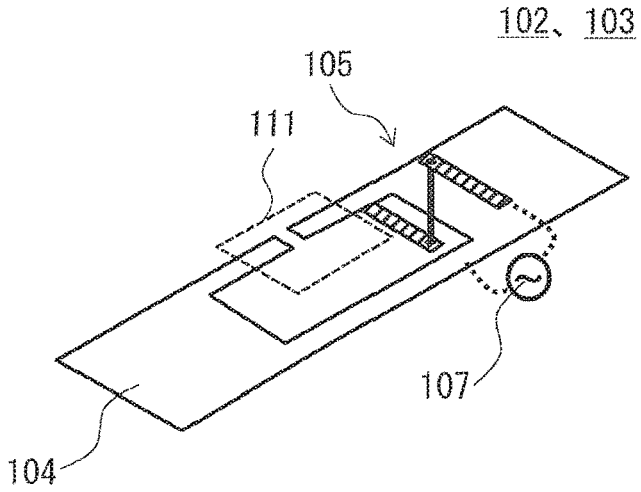
FIG. 10 is a perspective view of a modified example of the antenna element.
Figure 11:
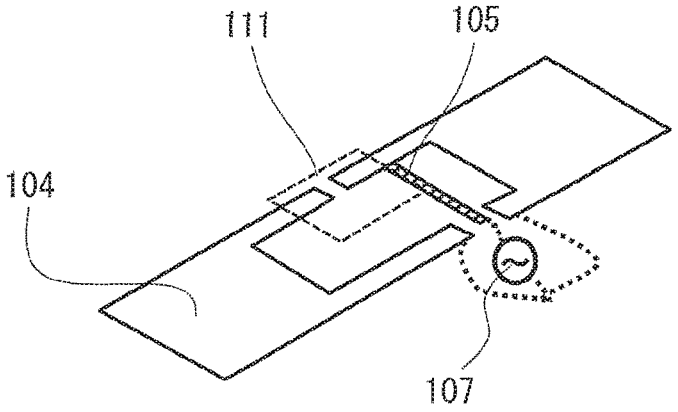
FIG. 11 is a perspective view of a modified example of the antenna element.
Figure 12:
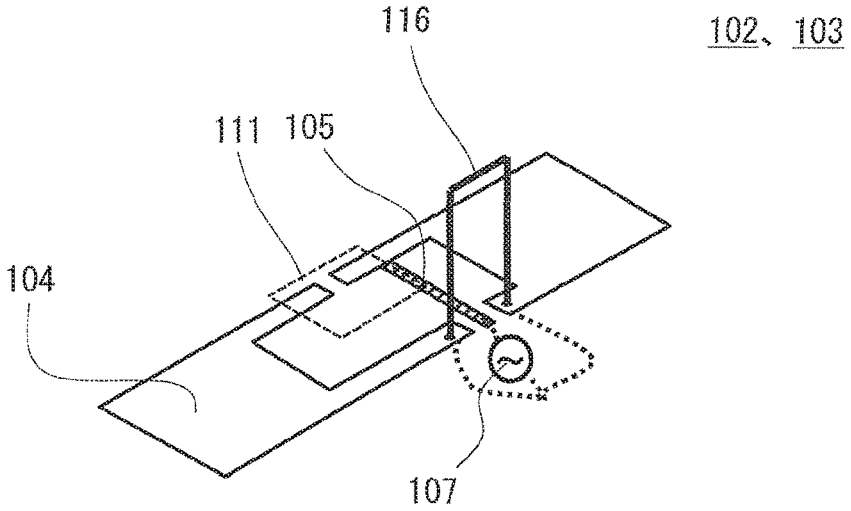
FIG. 12 is a perspective view of a modified example of the antenna element.

As shown in FIG. 8, for example, in order to improve the dimensional accuracy of the end parts of the conductor pattern when each of the two antenna elements 102 and 103 is formed, the dielectric layer 108 may have a size larger than that of the C-shaped conductor 104. Further, one end of the conductor feed line 105 may be directly connected in an electrically conductive manner to the part on a long side of the C-shaped conductor 104 that is away from the conductive reflector 101 and the conductive via 106 may not be provided. As shown in FIG. 9, for example, the conductor feed line 105 may be a linear conductor such as a copper line. Further, as shown in FIG. 10, when the feeding point 107 is provided in the end part of each of the two antenna elements 102 and 103, the conductor feed line 105 may be formed of a plurality of conductors and conductive vias for the purpose of preventing a contact between the other end of the conductor feed line 105 and the C-shaped conductor 104. Alternatively, as shown in FIG. 11, a part of the long side of the C-shaped conductor 104 that is close to the conductive reflector 101 may be cut out, the conductor feed line 105 may be provided in the cut out part, and the feeding point 107 may be provided to electrically excite a part between the conductor feed line 105 and the end parts of the C-shaped conductor 104 that form the cut out part. In this case, the C-shaped conductor 104 and the conductor feed line 105 may be formed on one layer so that the manufacturing process can be made simpler. Optionally, in order to compensate for the degradation of resonance characteristics of the split-ring resonator, which is due to the part of the C-shaped conductor 104 being cut out, as shown in FIG. 12, the C-shaped conductor 104 may include a bridging conductor 116 that makes the cut out part of the split-ring resonator conductive without allowing the cut out part to come in contact with the conductor feed line 105.

In addition, modifications may be made on the two antenna elements 102 and 103 to improve the electrical characteristics.

The split-ring resonator formed of the C-shaped conductor 104 serves as an LC series resonator in which the inductance by the current flowing along the ring and the capacitance generated between the conductors opposed to each other in the split part 111 are connected in series. In the vicinity of the resonance frequency of the split-ring resonator, a large current flows through the C-shaped conductor 104 and some of the current components contribute to the radiation, whereby the split-ring resonator formed of the C-shaped conductor 104 serves as an antenna. In this case, current components of the two antenna elements 102 and 103 in the longitudinal direction mainly contribute to the radiation in a current that flows through the C-shaped conductor 104. It is therefore possible to achieve excellent radiation efficiency by increasing the length of the C-shaped conductor 104 in the longitudinal direction. Although each of the antenna elements 102 and 103 has a substantially rectangular shape in FIGS. 1 and 2, the two antenna elements 102 and 103 may each have another shape as long as the two antenna elements 102 and 103 are arranged as shown in FIGS. 1, 2, and 3. The shape of the two antenna elements 102 and 103 does not affect the essential effects of the present invention. The two antenna elements 102 and 103 may be, for example, a square, a circle, or a triangle, or have a bow tie shape.

Figure 13:
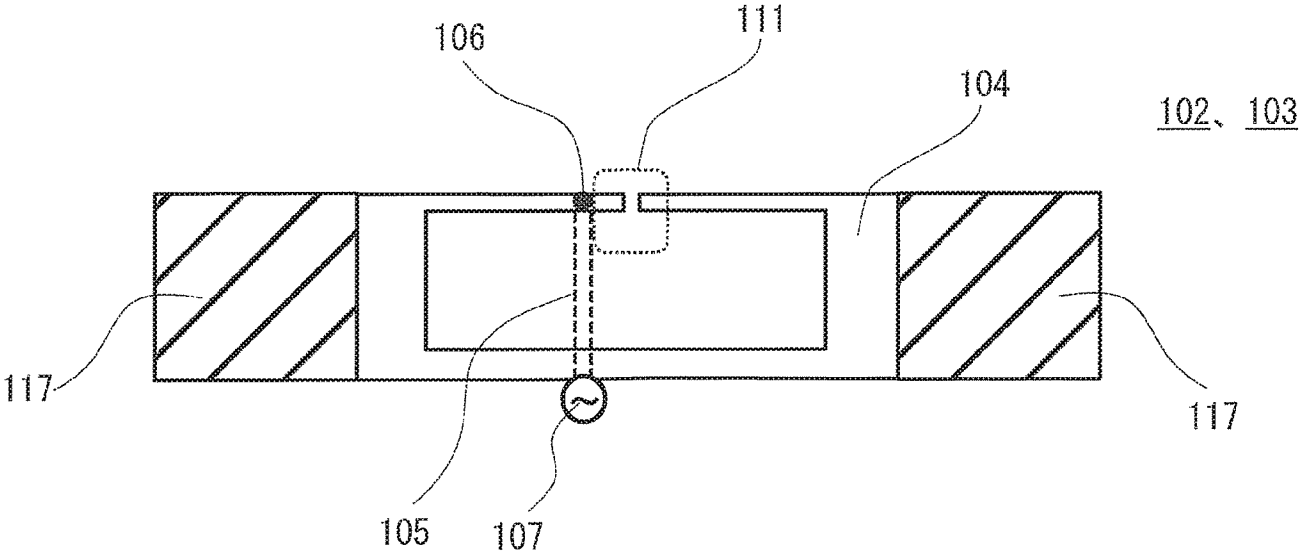
FIG. 13 is a front view of a modified example of the antenna element.
Figure 14:
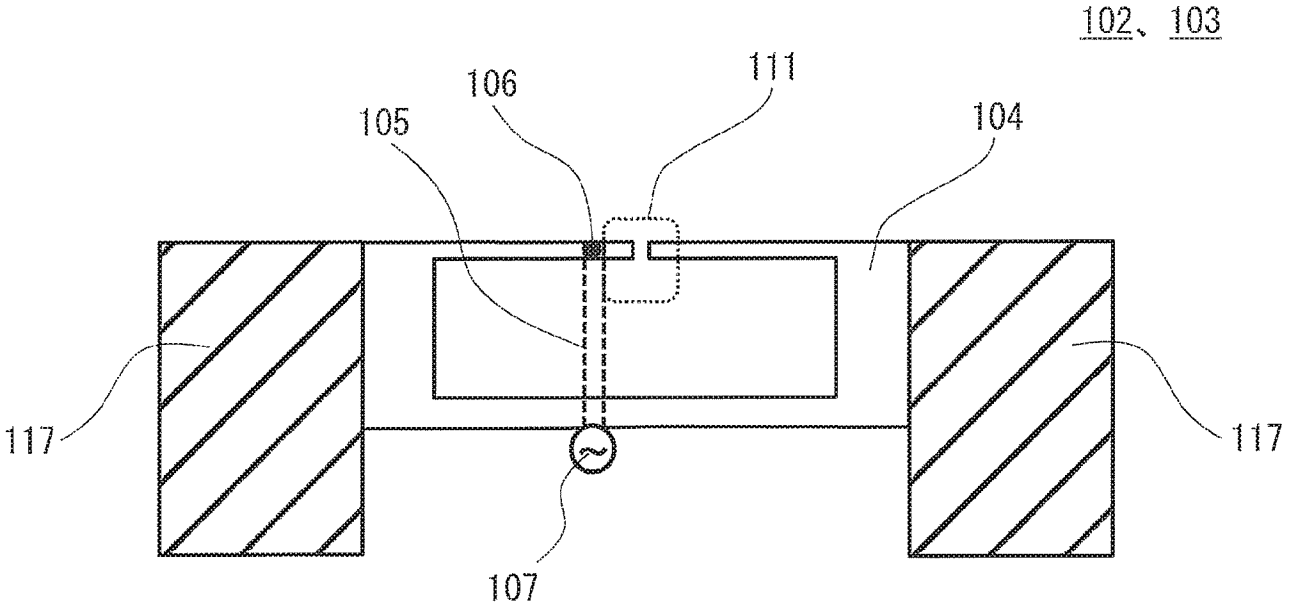
FIG. 14 is a front view of a modified example of the antenna element.
Figure 15:
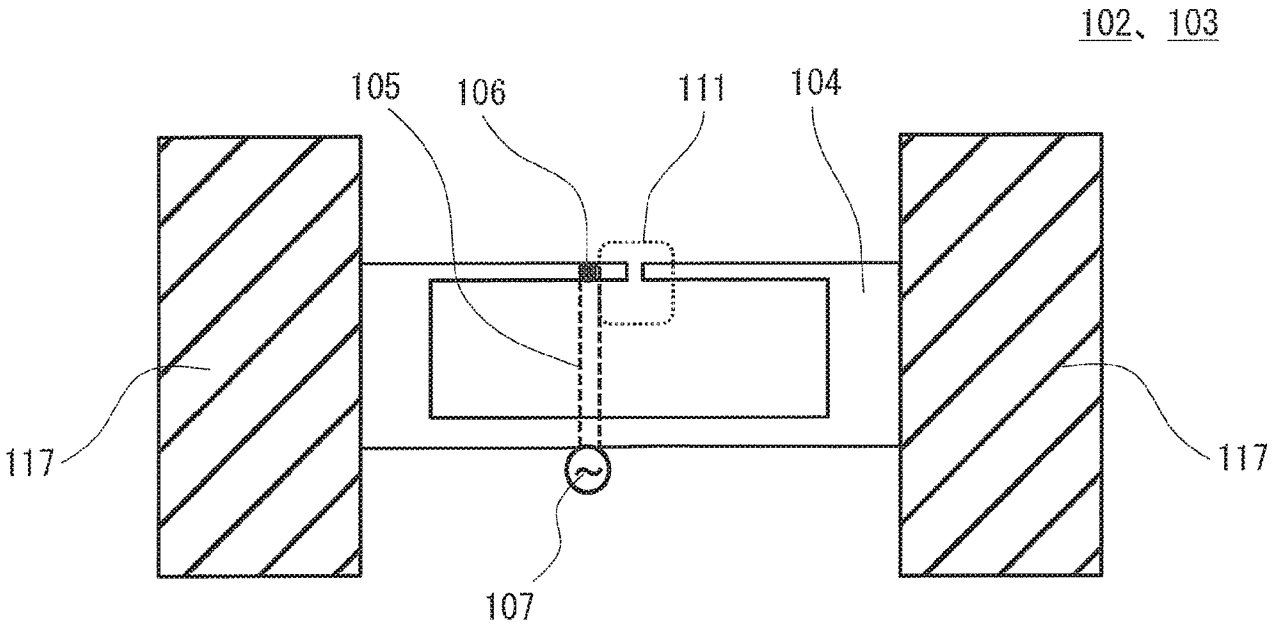
FIG. 15 is a front view of a modified example of the antenna element.
Figure 32:
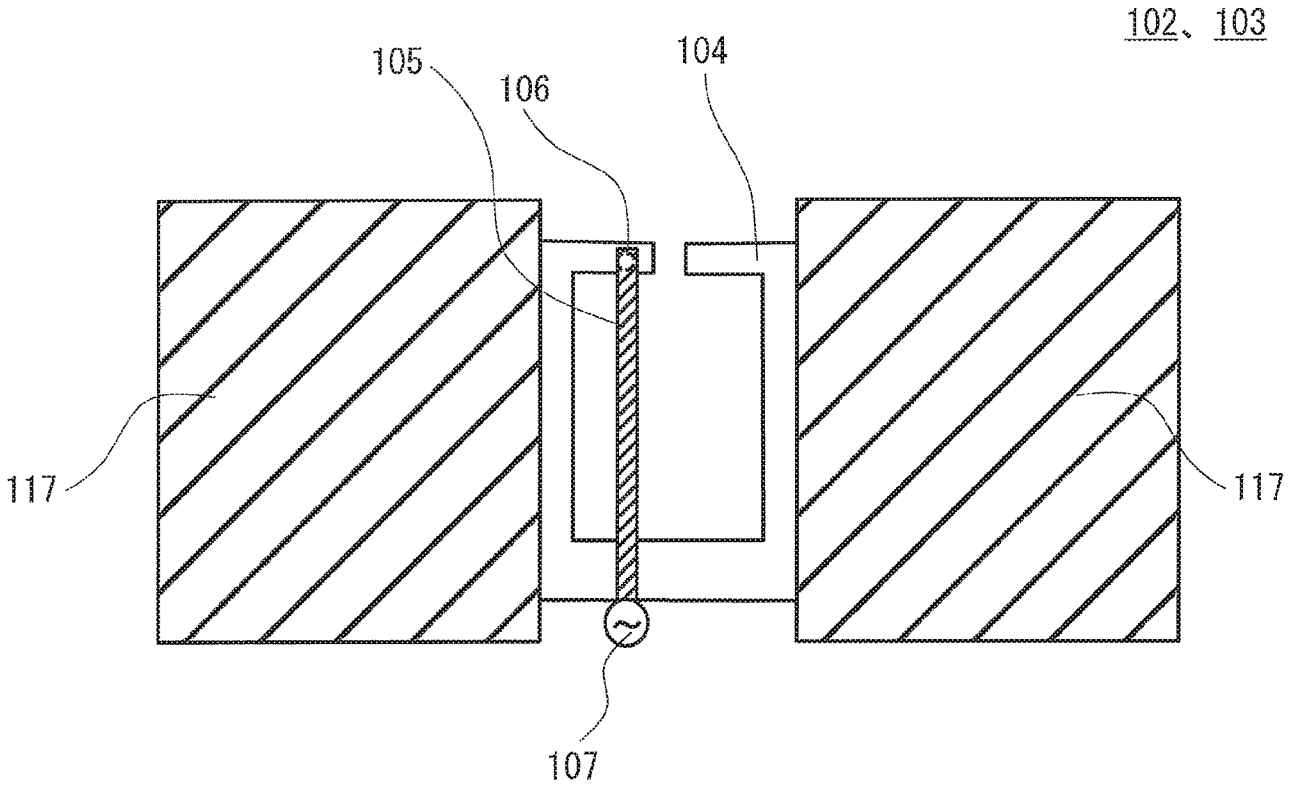
FIG. 32 is a front view of a modified example of the antenna element.

Further, as shown in FIG. 13, the two antenna elements 102 and 103 may each include conductive radiation parts 117 on the respective end parts of the C-shaped conductor 104 in the longitudinal direction. According to such a structure, the current components of the C-shaped conductor 104 in the longitudinal direction which contributes to the radiation can be induced to the radiation parts 117, whereby it is possible to improve the radiation efficiency. While the case in which the side of the radiation part 117 that is connected to the C-shaped conductor 104 has the length the same as that of the side of the C-shaped conductor 104 that is connected to the radiation part 117 is shown in FIG. 13, the shape of the radiation part 117 is not limited thereto. As shown in FIGS. 14 and 15, for example, the side of the radiation part 117 that is connected to the C-shaped conductor 104 may be longer than the side of the C-shaped conductor 104 that is connected to the radiation part 117. When the antenna elements 102 and 103 include the radiation parts 117, the antenna elements 102 and 103, together with the C-shaped conductor 104 and the radiation parts 117, may have a long side, whereby it is possible to achieve excellent radiation efficiency. In this case, the C-shaped conductor 104 does not necessarily have a long side in the longitudinal directions of the antenna elements 102 and 103. The shape of the C-shaped conductor 104 may be, for example, a rectangular shape having a long side in the z axis direction as shown in FIG. 32 (see FIG. 1 as well), or may be a square, a circle, or a triangle.

Figure 16:
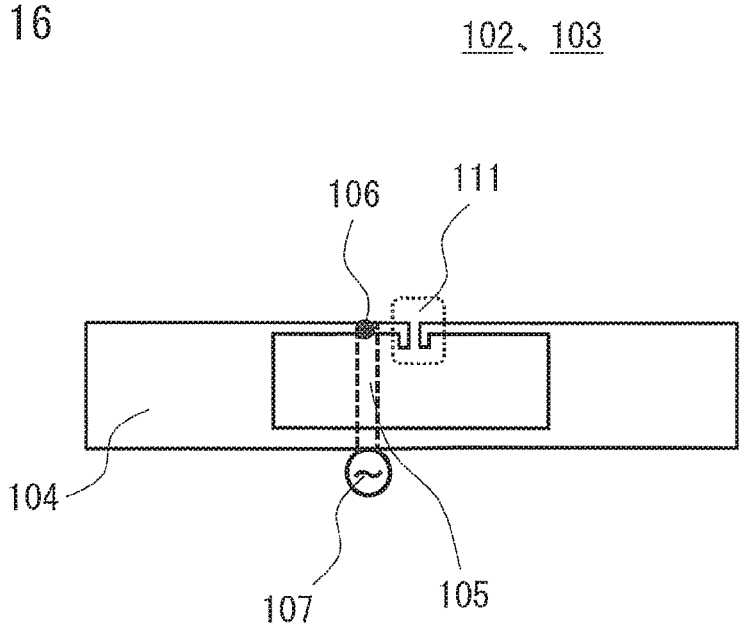
FIG. 16 is a front view of a modified example of the antenna element.
Figure 17:
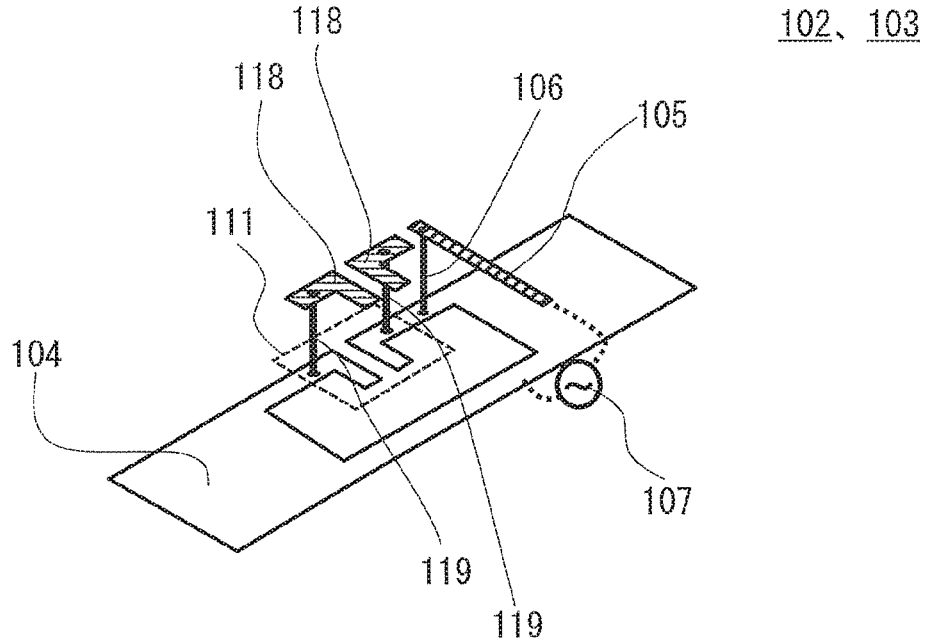
FIG. 17 is a perspective view of a modified example of the antenna element.
Figure 18:
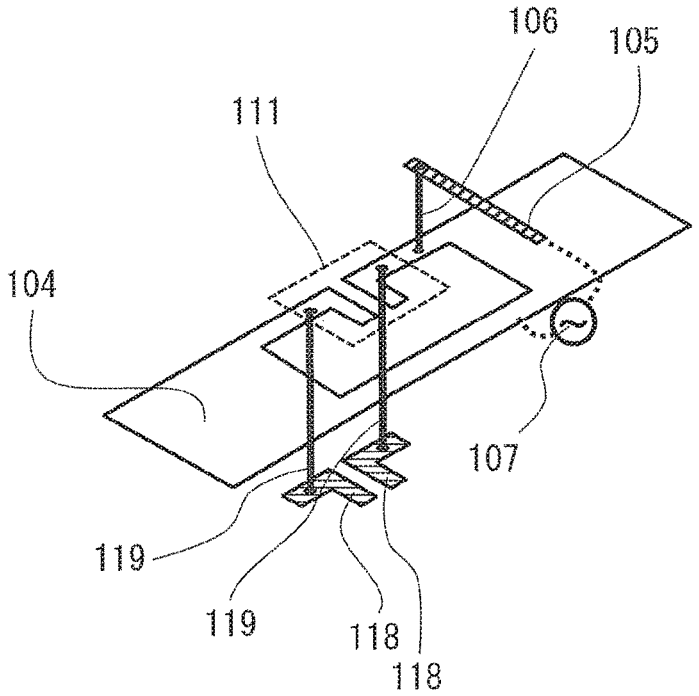
FIG. 18 is a perspective view of a modified example of the antenna element.
Figure 19:
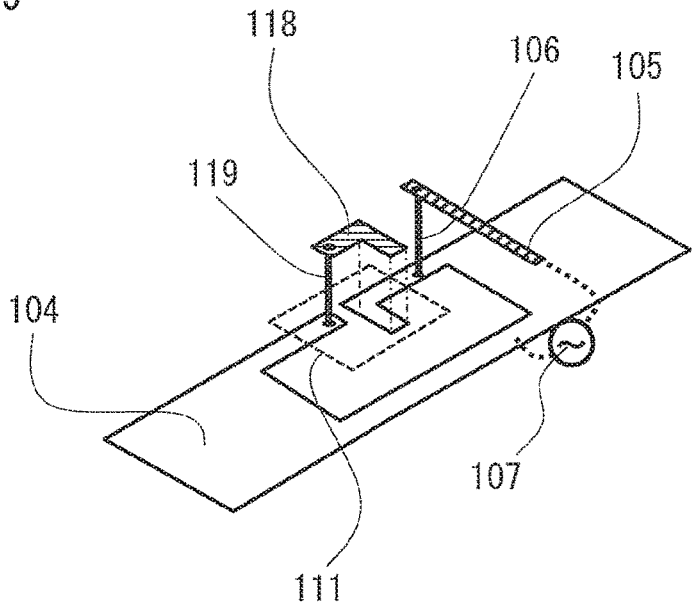
FIG. 19 is a perspective view of a modified example of the antenna element.

Further, the resonance frequency of the split-ring resonator formed by the C-shaped conductor 104 can be reduced by increasing the inductance by making the size of the ring of the split ring larger and making the current path longer, or by increasing the capacitance by narrowing the gap between the conductors opposed to each other in the split part 111. The above capacitance may be increased by increasing, for example, the area of the C-shaped conductors 104 that are opposed to each other and form the split part 111 as shown in FIG. 16. Alternatively, as shown in FIGS. 17 and 18, auxiliary conductor patterns 118 may be provided in a layer that is different from the layer where the C-shaped conductor 104 is formed and the auxiliary conductor patterns 118 may be connected to the split part 111 by conductive vias 119, to thereby increase the area of the conductors opposed to each other in the split part 111 in the split-ring resonator. FIG. 17 shows a case in which the auxiliary conductor patterns 118 are arranged in a layer the same as the layer where the conductor feed line 105 is formed. FIG. 18 shows a case in which the auxiliary conductor patterns 118 are arranged in a layer that is different from the layer where the C-shaped conductor 104 is formed and the layer where the conductor feed line 105 is formed. Further, as shown in FIG. 19, by providing the auxiliary conductor pattern 118 only in one conductor of the split part 111 and causing the auxiliary conductor pattern 118 and at least a part of the other conductor of the split part 111 to be opposed to each other between the layer of the C-shaped conductor 104 and the layer of the auxiliary conductor pattern 118, the area of the conductors opposed to each other in the split part 111 may be increased.

Figure 20:
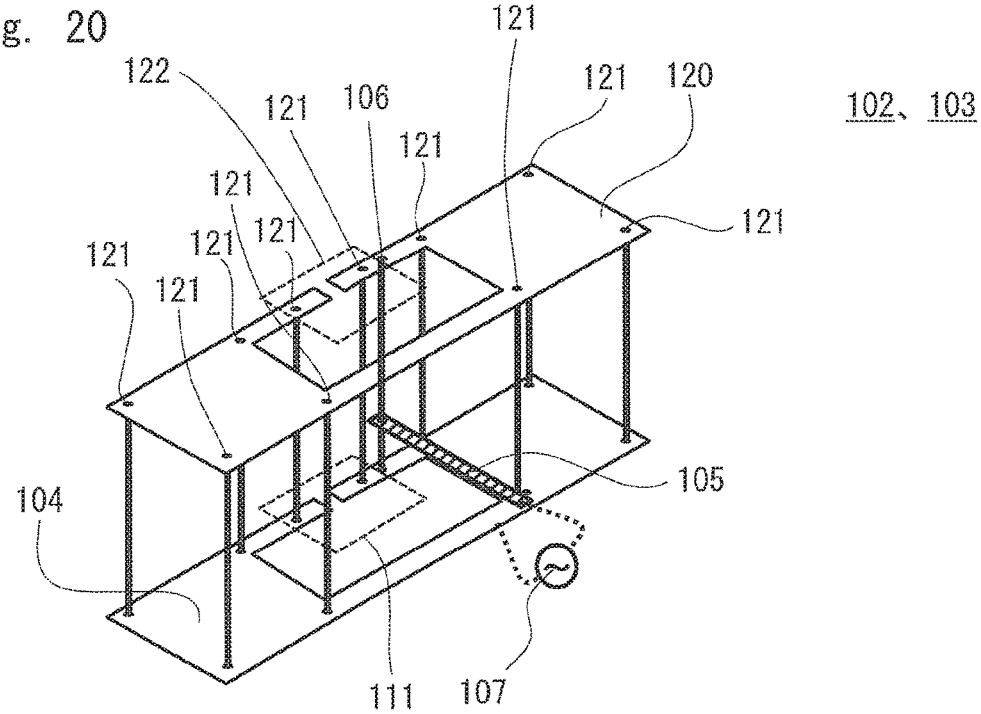
FIG. 20 is a perspective view of a modified example of the antenna element.
Figure 21:
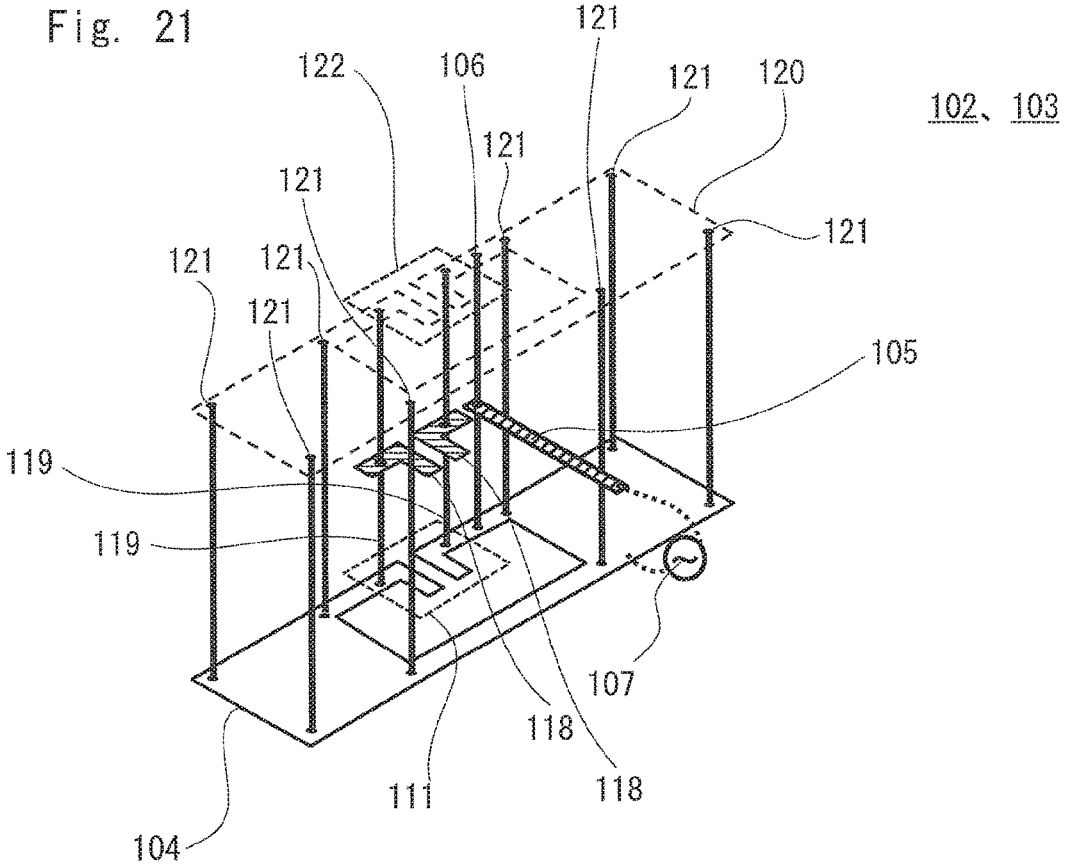
FIG. 21 is a perspective view of a modified example of the antenna element.

Further, by changing the connection position between the conductor via 106 or one end of the conductor feed line 105 when the conductive via 106 is not provided and the C-shaped conductor 104, the input impedance of the split-ring resonator seen from the feeding point 107 can be changed. By matching the impedance of a radio communication circuit (not shown) or a transmission line (not shown) connected to the feeding point 107 with the input impedance of the split-ring resonator, the radio communication signals can be supplied to the antenna without reflections. However, even when the impedances do not match each other, this does not affect the fundamental effects of the present invention. In addition, as shown in FIG. 20, a second C-shaped conductor 120 may be provided in a layer different from the layers where the C-shaped conductor 104 and the conductor feed line 105 are formed and the C-shaped conductor 104 and the second C-shaped conductor 120 may be electrically connected to each other via a plurality of conductive vias 121. In this case, the C-shaped conductor 104 and the second C-shaped conductor 120 serve as one split-ring resonator. In this case, the conductor feed line 105 is almost surrounded by the C-shaped conductor 104 and the second C-shaped conductor 120 that are electrically connected to each other and the plurality of conductive vias 121. It is therefore possible to reduce radiation of unwanted signal electromagnetic waves from the conductor feed line 105. Further, as shown in FIG. 21, similar to FIG. 17, the auxiliary conductor patterns 118 may be provided in a layer different from the layers in which the C-shaped conductor 104 and the second C-shaped conductor 120 are provided and connected to the split part 111 and the second split part 122 via the conductive vias 119. Since the area of the conductors opposed to each other in the split part 111 and the second split part 122 increases due to the presence of the auxiliary conductor patterns 118, it is possible to increase the capacitance without increasing the size of the whole resonator.

Further, since the conductive reflector 101 serves as a short-circuited plane, it is more preferable that a distance Z between the two antenna elements 102 and 103 and the conductive reflector 101 shown in FIG. 2 be substantially one quarter of the wavelength when the electromagnetic waves whose frequency is a resonance frequency of the antenna elements travel through a substance that fills the region in order to suppress the influence of the antenna elements on the resonance characteristics. Even when the distance Z is not substantially one quarter of the wavelength, this does not affect the fundamental effects of the present invention. Further, the distance Z in the antenna element 102 and the distance Z in the antenna element 103 may be different from each other.

Figure 22:
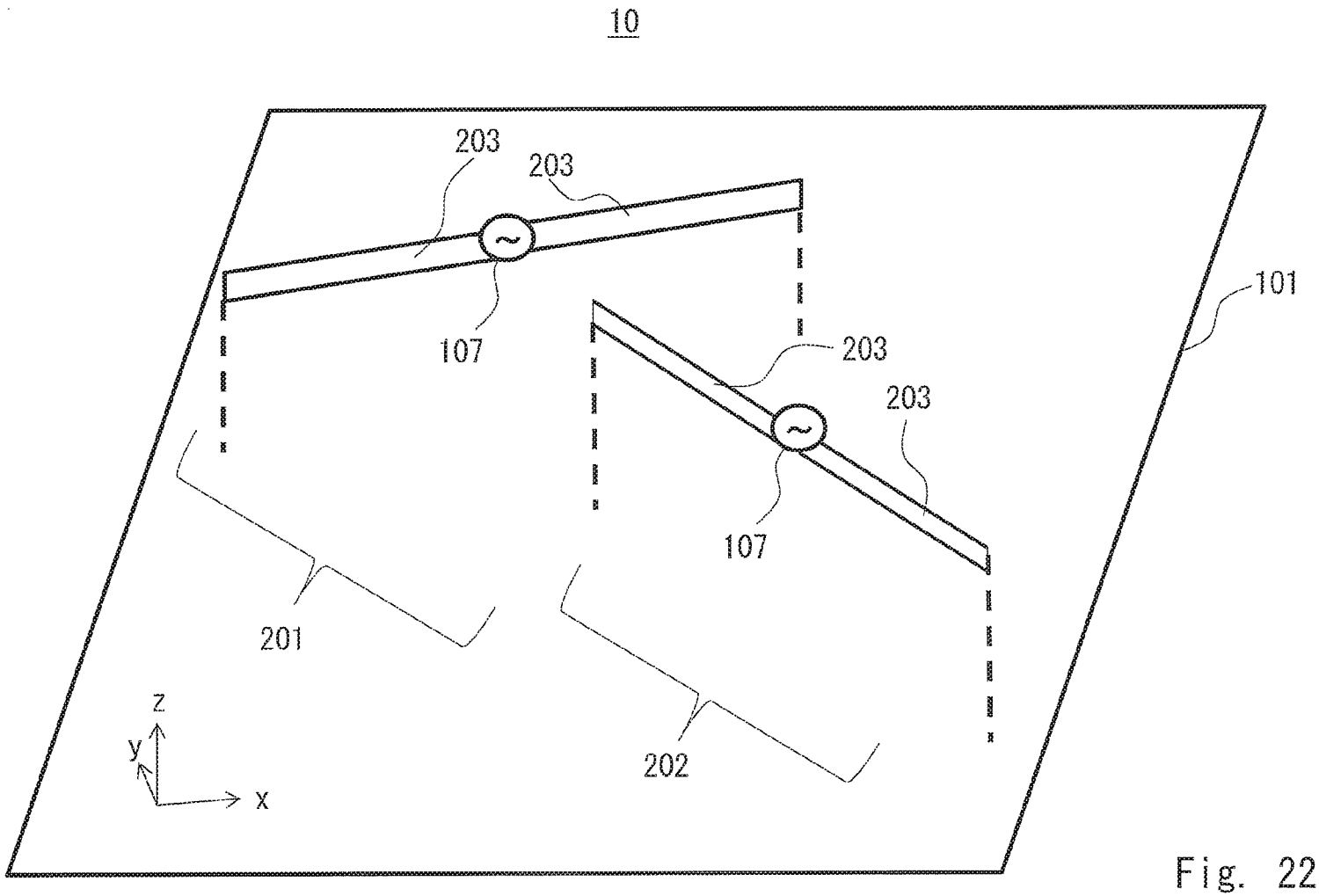
FIG. 22 is a perspective view of a modified example of the antenna.

In addition, in dipole antenna elements in which parts near both of the end parts can be regarded as electrically open planes and parts near the approximate centers can be regarded as electrically short-circuited planes at resonance as well, by employing the arrangement as shown in FIGS. 1, 2, and 3 in this embodiment, as shown in FIG. 22, the dual-polarized antenna in which the antenna elements are highly integrated and the size of the whole antenna is reduced can be formed while suppressing the coupling between the two antenna elements without having the two antenna elements overlap each other. In FIG. 22, two dipole antenna elements 201 and 202 each include a radiation part 203 formed of two conductors that have a length of about the substantially half wavelength and are arranged with an interval therebetween and the feeding point 107 that excites the part between the two conductors of the radiation part 203.

(Second Embodiment)

An antenna 20 according to a second embodiment of the present invention will now be described.

Figure 23:
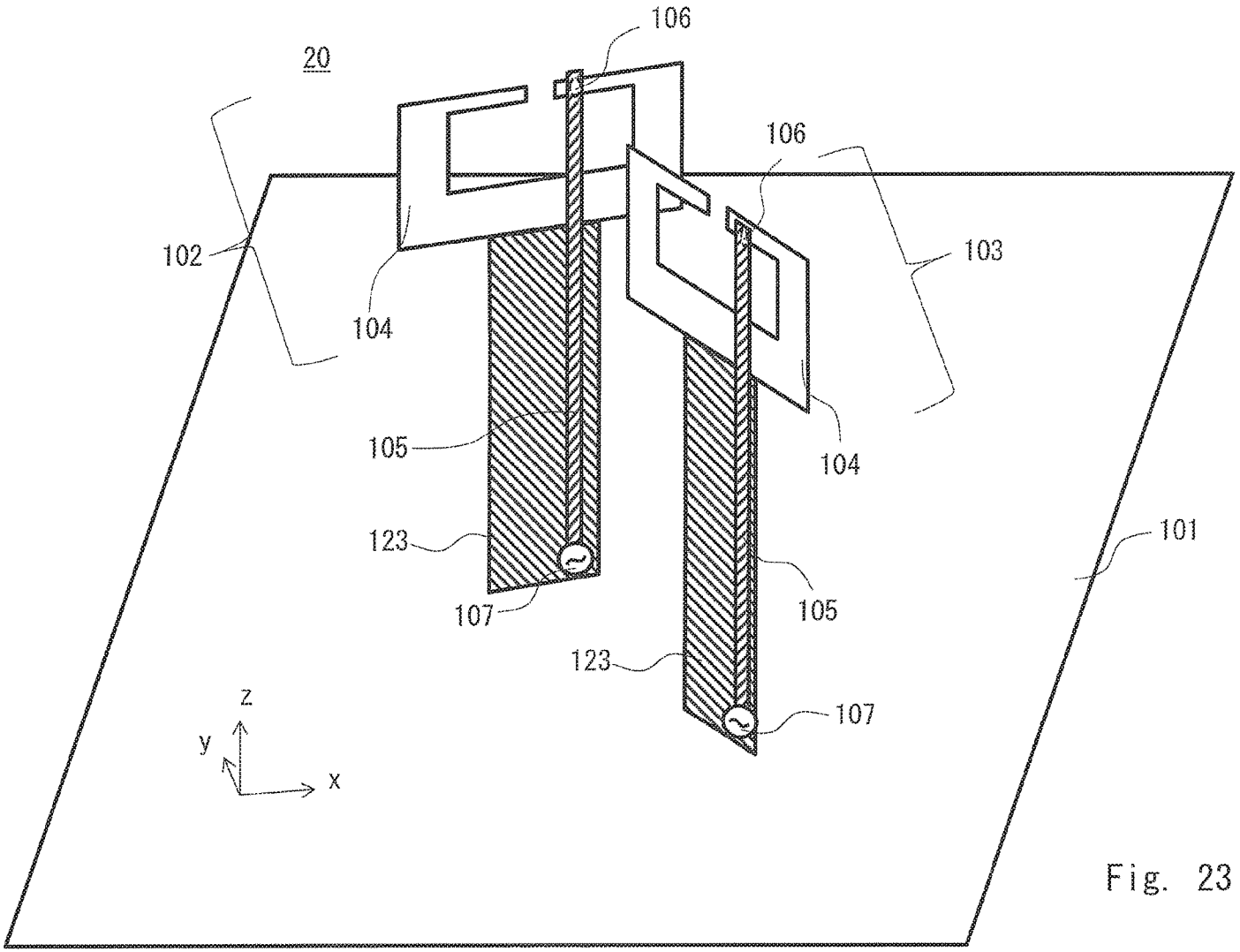
FIG. 23 is a perspective view of a modified example of the antenna.
Figure 24:
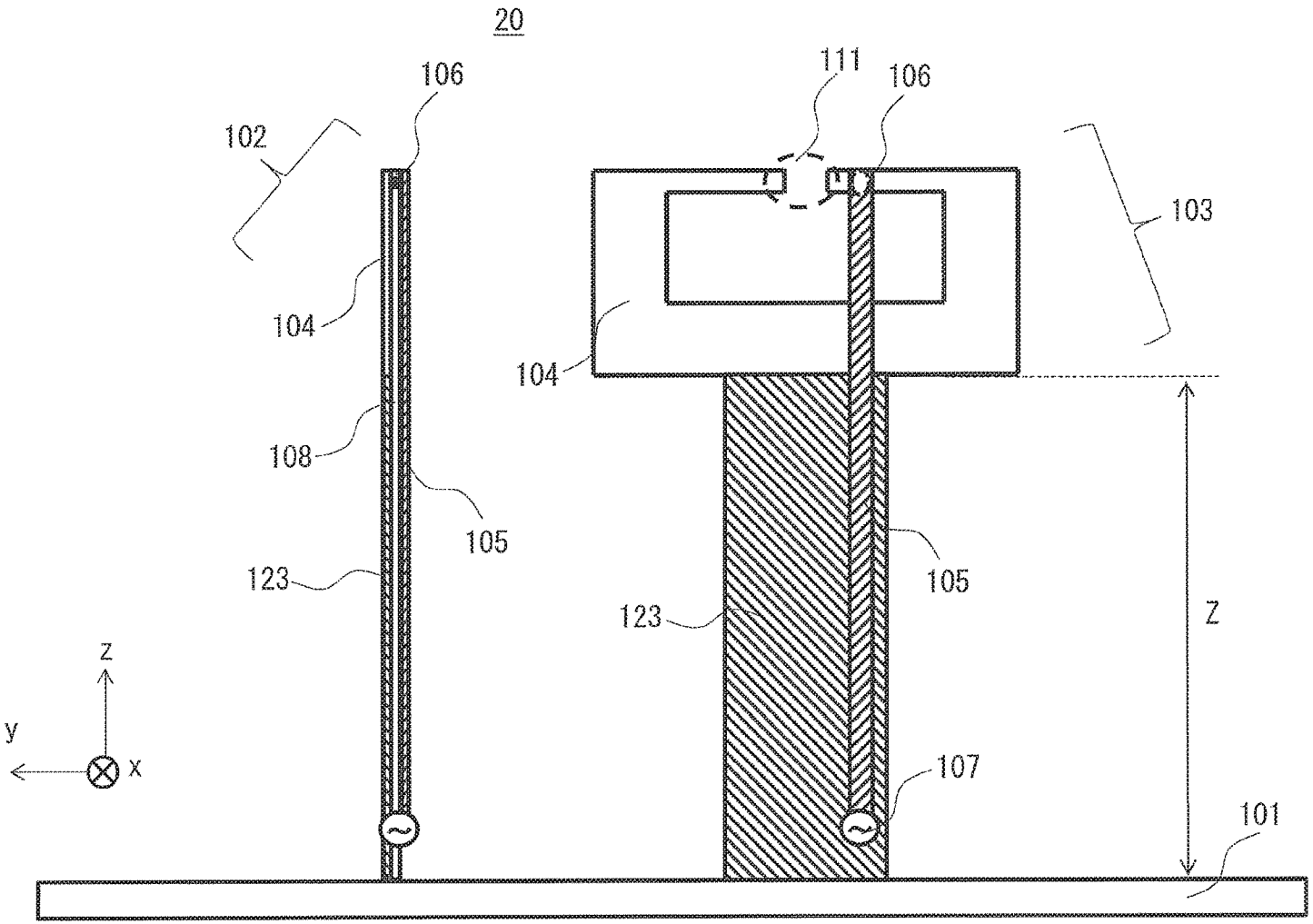
FIG. 24 is a front view of a modified example of the antenna.

FIG. 23 is a perspective view of the antenna 20 and FIG. 24 is a front view of the antenna 20. As shown in FIGS. 23 and 24, the antenna 20 includes, in at least one or both of the two antenna elements 102 and 103, a conductor feed GND part 123 having one end connected to a part near the end part of the C-shaped conductor 104 opposed to the split part 111 and the other end connected to the conductive reflector 101, the conductor feed GND part 123 being opposed to the conductor feed line 105. In this embodiment, the antenna 20 includes two conductor feed GND parts 123. One conductor feed GND part 123 electrically connects the approximate center of an outer edge of the antenna element 102 that extends in a C shape and the conductive reflector 101. More specifically, one conductor feed GND part 123 electrically connects the approximate center of the outer edge that is opposed to the outer edge where the split part 111 is formed among four outer edges of the antenna element 102 and the conductive reflector 101. The other conductor feed GND part 123 electrically connects the approximate center of the outer edge of the antenna element 103 that extends in a C shape and the conductive reflector 101. More specifically, the other conductor feed GND part 123 electrically connects the approximate center of the outer edge that is opposed to the outer edge where the split part 111 is formed among four outer edges of the antenna element 103 and the conductive reflector 101. Further, the conductor feed line 105 and the dielectric layer 108 are extended on the side of the conductive reflector 101. Then the feeding point 107 is arranged near one of the end parts of the conductor feed line 105 that has been extended and is able to electrically excite a part between the one of the end parts of the conductor feed line 105 that has been extended and the neighboring conductor feed GND part 123. While the conductor feed GND part 123 is connected to the conductive reflector 101 in this example, it may not be connected to the conductive reflector 101.

The antenna element 102 includes the C-shaped conductor 104 having a substantially C shape and the conductor feed line 105 having one end connected to the C-shaped conductor 104. The C-shaped conductor 104 is formed by cutting out a part of a substantially ring-shaped conductor. The C-shaped conductor 104 includes the split part 111, which corresponds to the cut out part of the C-shaped conductor 104. The same is also applicable to the antenna element 103.

The antenna element 102 includes the conductor feed GND part 123 arranged to be opposed to the conductor feed line 105. The conductor feed GND part 123 has one end that is connected to the outer edge of the C-shaped conductor 104. The conductor feed GND part 123 has the other end that is connected to the conductive reflector 101. That is, the conductor feed GND part 123 electrically connects the outer edge of the C-shaped conductor 104 and the conductive reflector 101. The same is also applicable to the antenna element 103.

The outer edge of the C-shaped conductor 104 extends in a C shape. One end of the conductor feed GND part 123 is connected to the approximate center of the outer edge that extends in the C shape. In other words, one end of the conductor feed GND part 123 is connected to the approximate center of the outer edge that is opposed to the outer edge where the split part 111 is formed among four outer edges included in the C-shaped conductor 104.

The antenna 20 and the antenna 10 according to the first embodiment are the same except for the point stated above.

The effects of the second embodiment will now be described.

When the transmission line that transmits radio signals is connected to each of the two antenna elements 102 and 103 via the feeding point 107, the conductor is connected to the resonator.

Therefore, the resonance characteristics of the two antenna elements 102 and 103 may be changed depending on the arrangement and the shape of the transmission lines near the two antenna elements 102 and 103.

However, the parts in the antenna 20 in which the conductor feed GND parts 123 are connected to the two respective antenna elements 102 and 103 are positioned at the approximate centers of the antenna elements. As described in the first embodiment, these parts of the C-shaped conductors, which are resonators, are electrically short-circuited planes at resonance. In this case, the present inventors have found that the conductor feed GND parts 123 do not increase extra capacitance or inductance that may affect the resonance characteristics, and therefore the resonance characteristics of the two antenna elements 102 and 103 are not substantially changed.

Accordingly, by extending the conductor feed line 105 so that it becomes opposed to the conductor feed GND part 123, it is possible to form a transmission line that is composed of the conductor feed line 105 that has been extended and the conductor feed GND part 123, which are two conductors that are opposed to each other, and is connected to the antenna elements without affecting the resonance characteristics. By providing the feeding point 107 at the tip of the transmission line, the distance between another transmission line connected to the feeding point 107 and the two antenna elements 102 and 103 can be increased, whereby it is possible to reduce the influence of the transmission line on the two antenna elements 102 and 103.

As described above, it is possible to provide a dual-polarized antenna in which the influence of the transmission line on the resonance characteristics of the antenna elements is suppressed and a communication apparatus and a communication system that use the dual-polarized antenna.

Note that all the modified examples of the two antenna elements 102 and 103 described in the first embodiment may be applied also to the two antenna elements 102 and 103 according to this embodiment. The antenna elements 102 and 103 may be, for example, parallel to the conductive reflector 101, as shown in FIG. 7. In this case, the conductor feed GND part 123 may be formed of a plurality of conductive vias in the substrate, the conductor feed line 105 opposed to the conductor feed GND part 123 may be formed of a conductive via in the same substrate, and all the components including the antenna elements 102 and 103 that have the common conductive reflector 101 and the common dielectric layer 108 may be formed in an integrated substrate.

Figure 34:
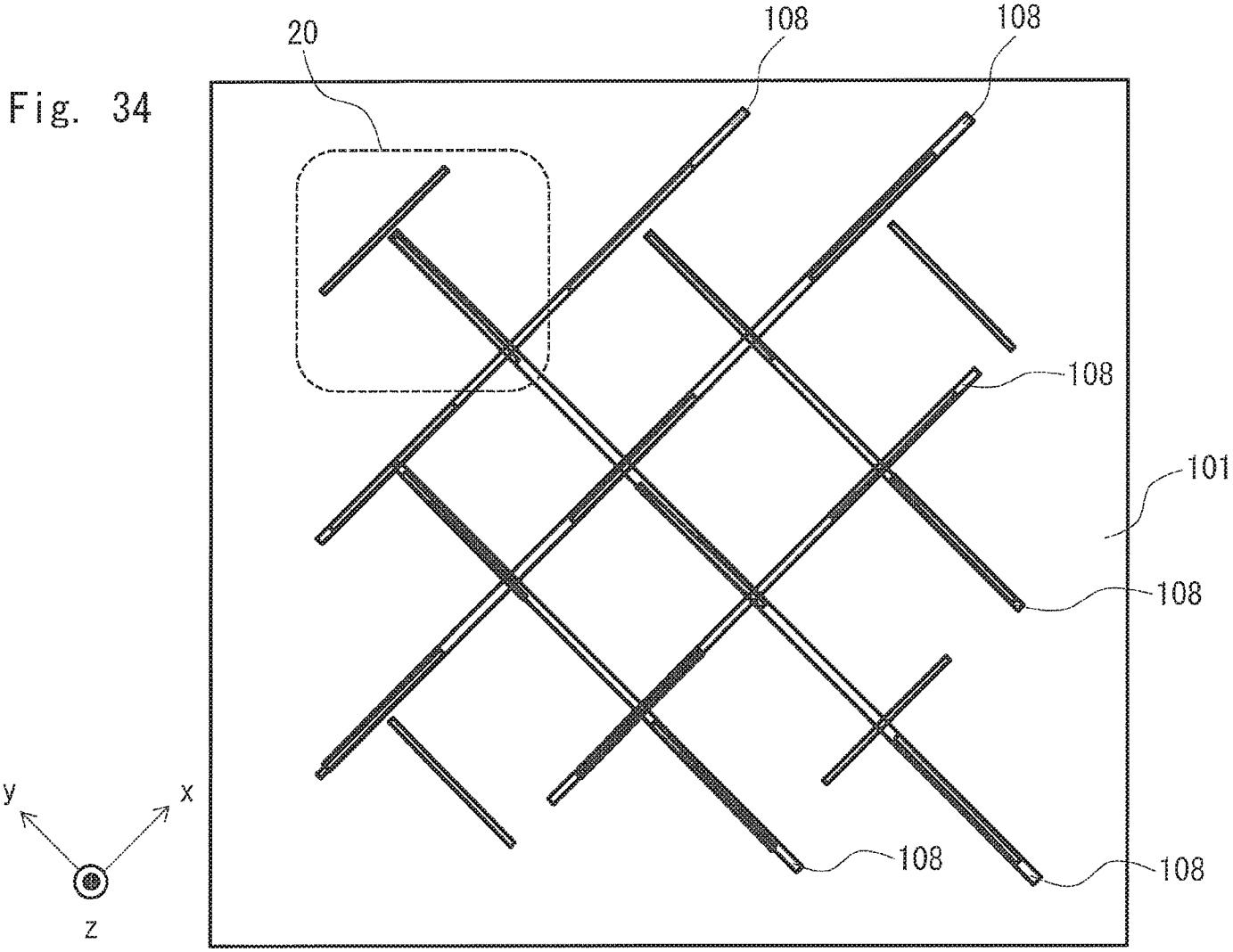
FIG. 34 is a plan view of a modified example of the antenna array.

Further, in an array antenna in which a plurality of antennas 20 according to this embodiment are arranged, as shown in FIG. 34, among the antenna elements 102 and the conductor feed GND parts 123 coupled to the antenna elements 102 of the plurality of antennas 20, the antenna elements 102 and the conductor feed GND parts 123 that are arranged on one plane may be formed on the dielectric layer 108 while integrating the dielectric layer 108. The same is also applicable to the antenna elements 103 and the conductor feed GND parts 123 coupled to the antenna elements 103 of the plurality of antennas 20. By forming the array antenna as stated above, the steps required to align the plurality of antenna elements and the plurality of conductor feed GND parts 123 can be reduced. In this case, however, one of the dielectric layers 108 that are orthogonal to each other needs to be partially cut.

Further, as described above, the conductor feed GND part 123 is preferably connected to the outer edge of each of the antenna elements 102 and 103 corresponding to the approximate center of the antenna elements 102 and 103, which are electrically short-circuited planes at resonance. More specifically, the planes that include the center of the antenna elements 102 and 103 and are orthogonal to the longitudinal directions of the antenna elements 102 and 103 (102 is arranged along the x-axis direction and 103 is arranged along the y-axis direction) serve as electrically short-circuited planes at resonance. Since the planes which are in the range of ¼ of the size of the antenna elements 102 and 103 in the longitudinal directions (when the antenna elements 102 and 103 include the radiation parts 117, the size of the antenna elements 102 and 103 plus the radiation parts 117) in the antenna element longitudinal direction from the electrically short-circuited plane can be regarded as short-circuited planes, the conductor feed GND parts 123 are preferably positioned within this range. Therefore, the size of the conductor feed GND parts 123 in the antenna element longitudinal direction is preferably equal to or smaller than ½ of the size of the antenna element in the longitudinal direction. Even when the conductor feed GND parts 123 are positioned outside the above range, this does not affect the fundamental effects of the present invention. Further, even when the size of the conductor feed GND parts 123 in the antenna element longitudinal direction is outside the above range, this does not affect the fundamental effects of the present invention.

Figure 25:
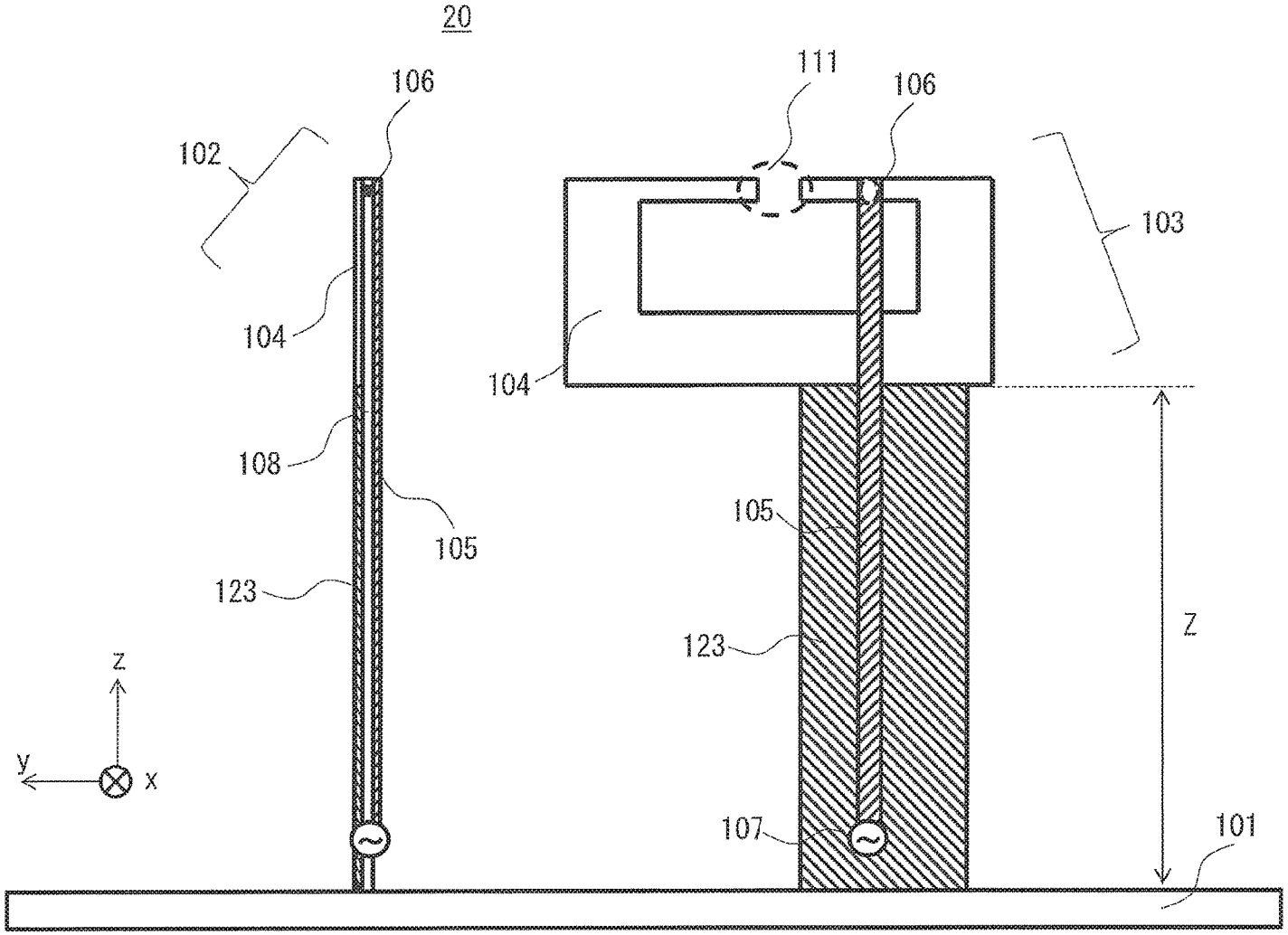
FIG. 25 is a front view of a modified example of the antenna.

While each of the conductor feed GND parts 123 has one end that is connected to the approximate center of the end part of each of the antenna elements 102 and 103 corresponding to a part of the C-shaped conductor 104 that is opposed to the split part 111 in FIGS. 23 and 24, the conductor feed GND part 123 may be connected to another part of the C-shaped conductor 104 as shown in FIG. 25 as long as the connection of the conductor feed GND part 123 has no great influence on the resonance characteristics of the two antenna elements 102 and 103.

Further, the input impedance to the antenna seen from the feeding point 107 depends on the connection position between the conductive via 106 or one end of the conductor feed line 105 when the conductive via 106 is not provided and the C-shaped conductor 104, as described in the first embodiment. In the antenna 20 according to this embodiment, however, the input impedance to the antenna also depends on the characteristic impedance of the transmission line formed of the conductor feed line 105 that has been extended and the conductor feed GND part 123. By matching the characteristic impedance of the aforementioned transmission line with the input impedance of the split-ring resonator, the radio communication signals may be supplied to the antenna without reflections between the aforementioned transmission line and the split-ring resonator. Even when the impedances do not match, this does not affect the essential effects of the present invention.

Figure 26:
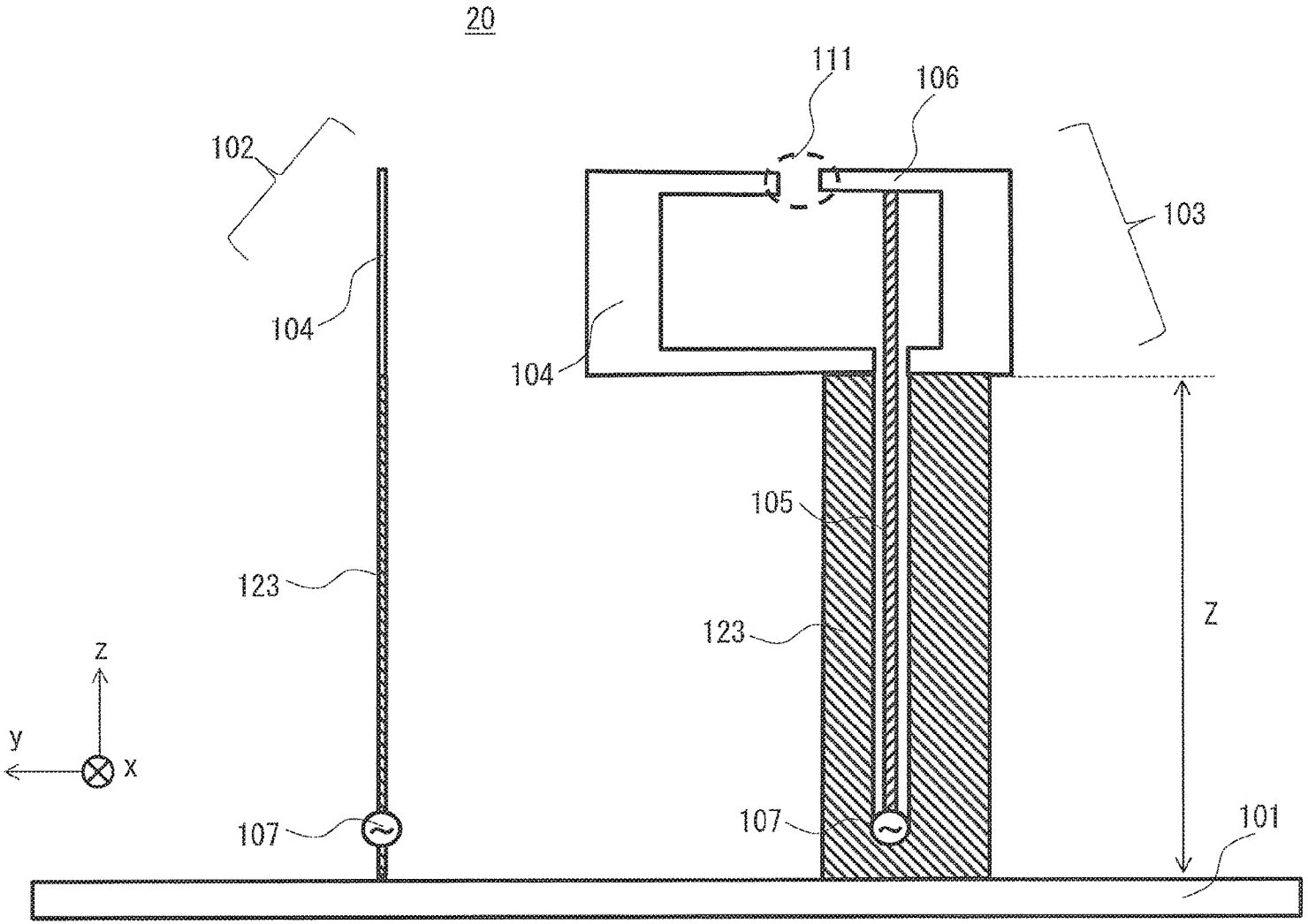
FIG. 26 is a front view of a modified example of the antenna.

Further, as shown in FIG. 26, the transmission line formed of the above extended conductor feed line 105 and the conductor feed GND part 123 may be a coplanar line and the C-shaped conductor 104, the conductor feed line 105, and the conductor feed GND part 123 may be formed on one layer. In this case, in each of the two antenna elements 102 and 103, as shown in FIGS. 11 and 12 in the first embodiment, a part of the long side of the C-shaped conductor 104 which is close to the conductive reflector 101 is cut out and the conductor feed line 105 is provided in the cut out part. Then, the aforementioned cut out part is directly connected to the slit of the conductor feed GND part 123 and the conductor feed line 105 is further extended in the direction of the conductive reflector 101 and passes through the slit, whereby the transmission line formed of the aforementioned conductor feed line 105 and the conductor feed GND part 123 can serve as the coplanar line.

Figure 27:
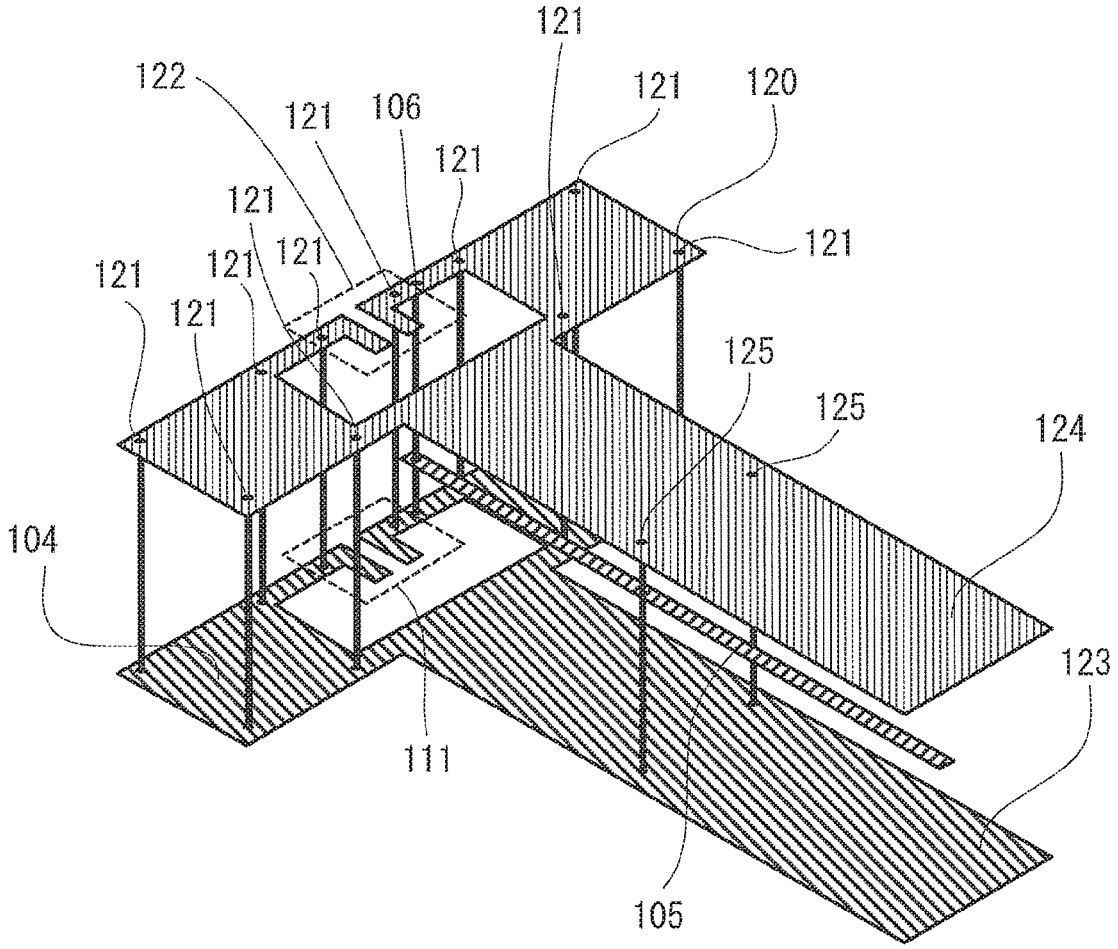
FIG. 27 is a perspective view of a modified example of the antenna.

Further, as shown in FIG. 27, in the antenna 20, the two antenna elements 102 and 103 may each include the second C-shaped conductor 120 and the plurality of conductive vias 121, as shown in FIGS. 20 and 21 in the first embodiment and further include a second conductor feed GND part 124 and a plurality of conductive vias 125. The second conductor feed GND part 124 is connected to the second C-shaped conductor 120 in a way similar to the way that the conductor feed GND part 123 is connected to the C-shaped conductor 104 and is opposed to the conductor feed line 105. The plurality of conductive vias 125 then electrically connect the conductor feed GND part 123 and the second conductor feed GND part 124. In this case, a large part of the conductor feed line 105 is surrounded by, besides the C-shaped conductor 104 and the second C-shaped conductor 120 that are electrically connected to each other and the plurality of conductive vias 121, by the second conductor feed GND part 124 and the plurality of conductive vias 125. It is therefore possible to reduce radiation of unwanted signal electromagnetic waves from the conductor feed line 105.

Figure 28:
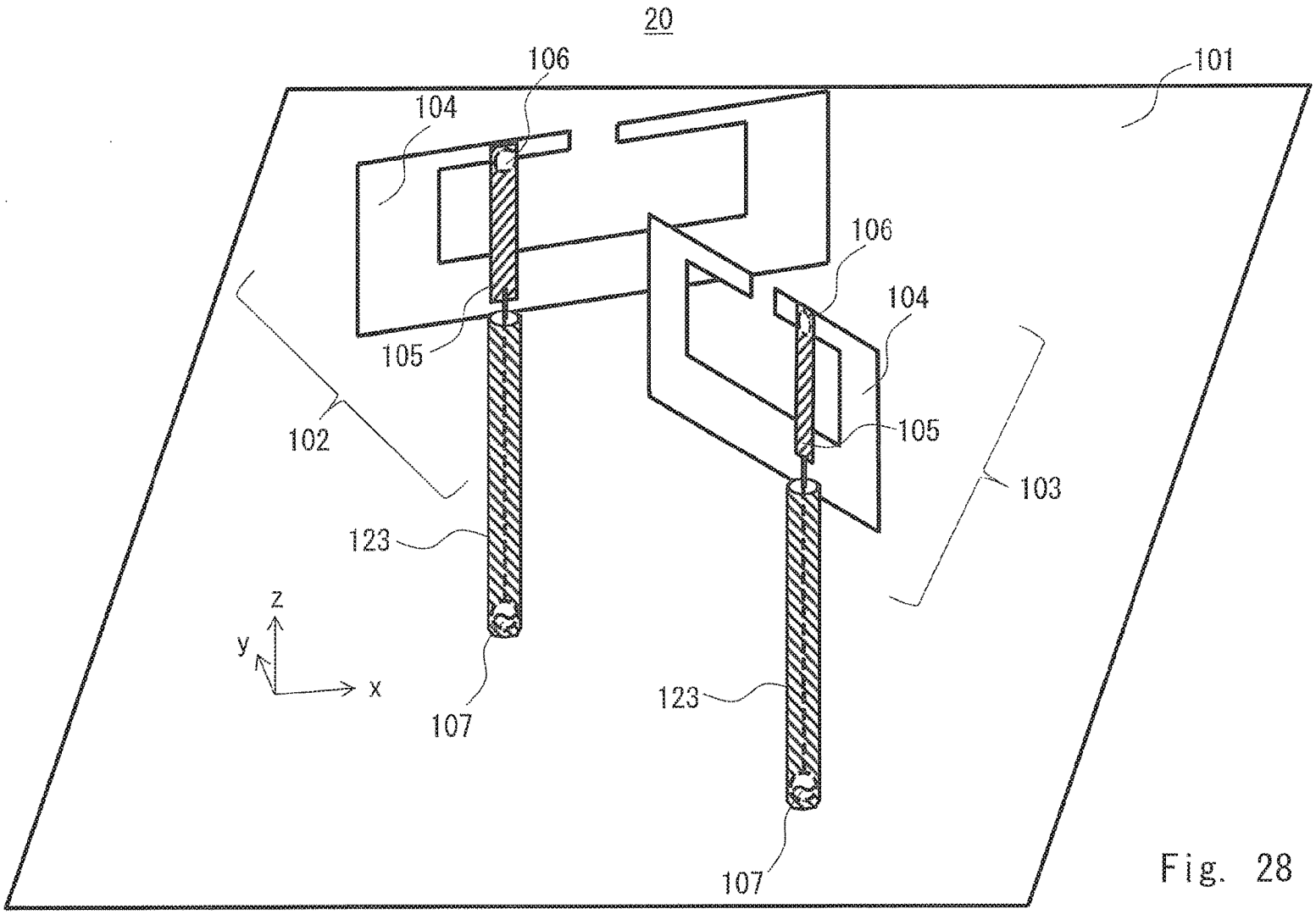
FIG. 28 is a perspective view of a modified example of the antenna.

Further, as shown in FIG. 28, the transmission line formed of the aforementioned extended conductor feed line 105 and the conductor feed GND part 123 may be a coaxial line.

Figure 29:
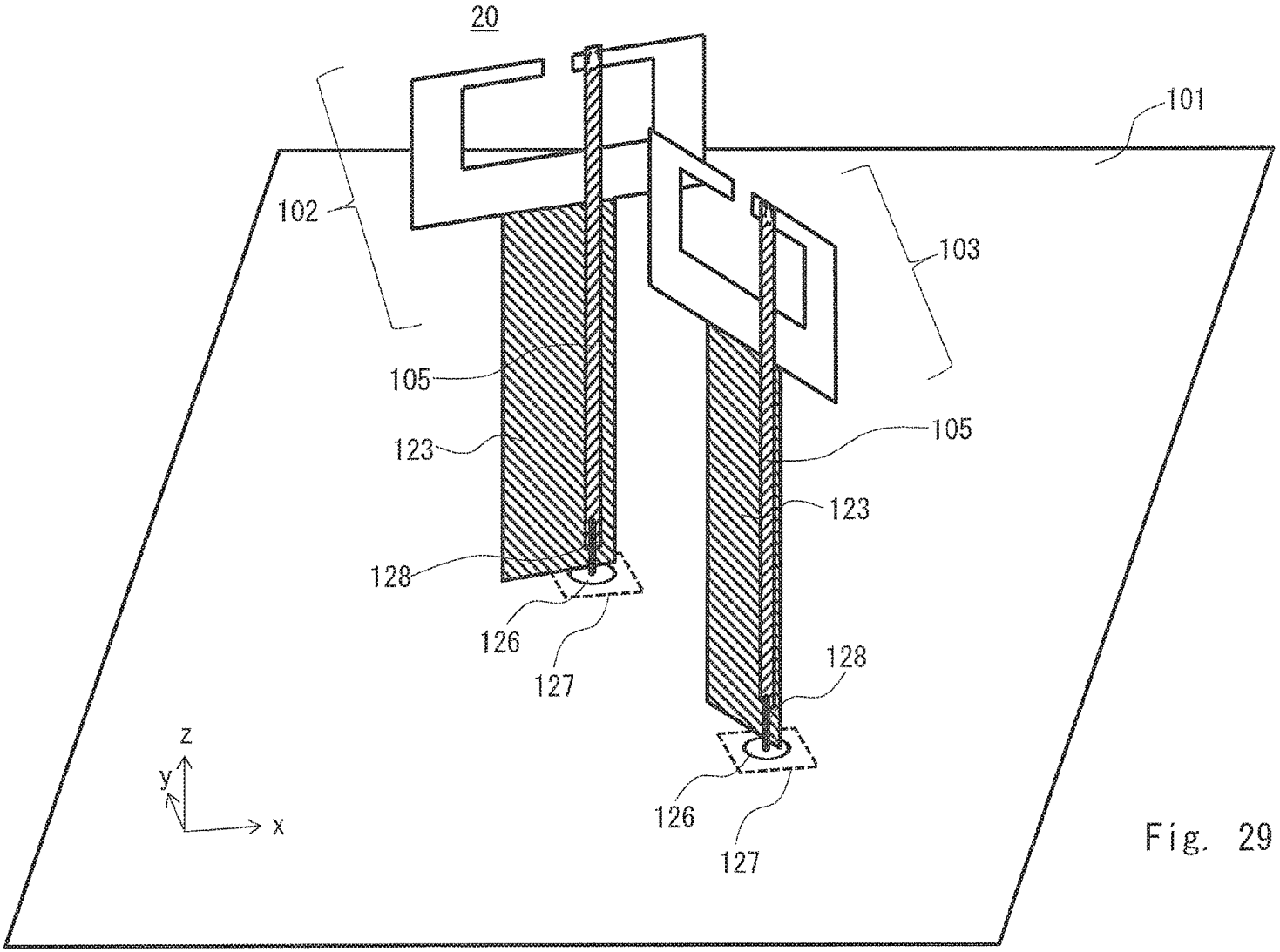
FIG. 29 is a perspective view of a modified example of the antenna.
Figure 30:
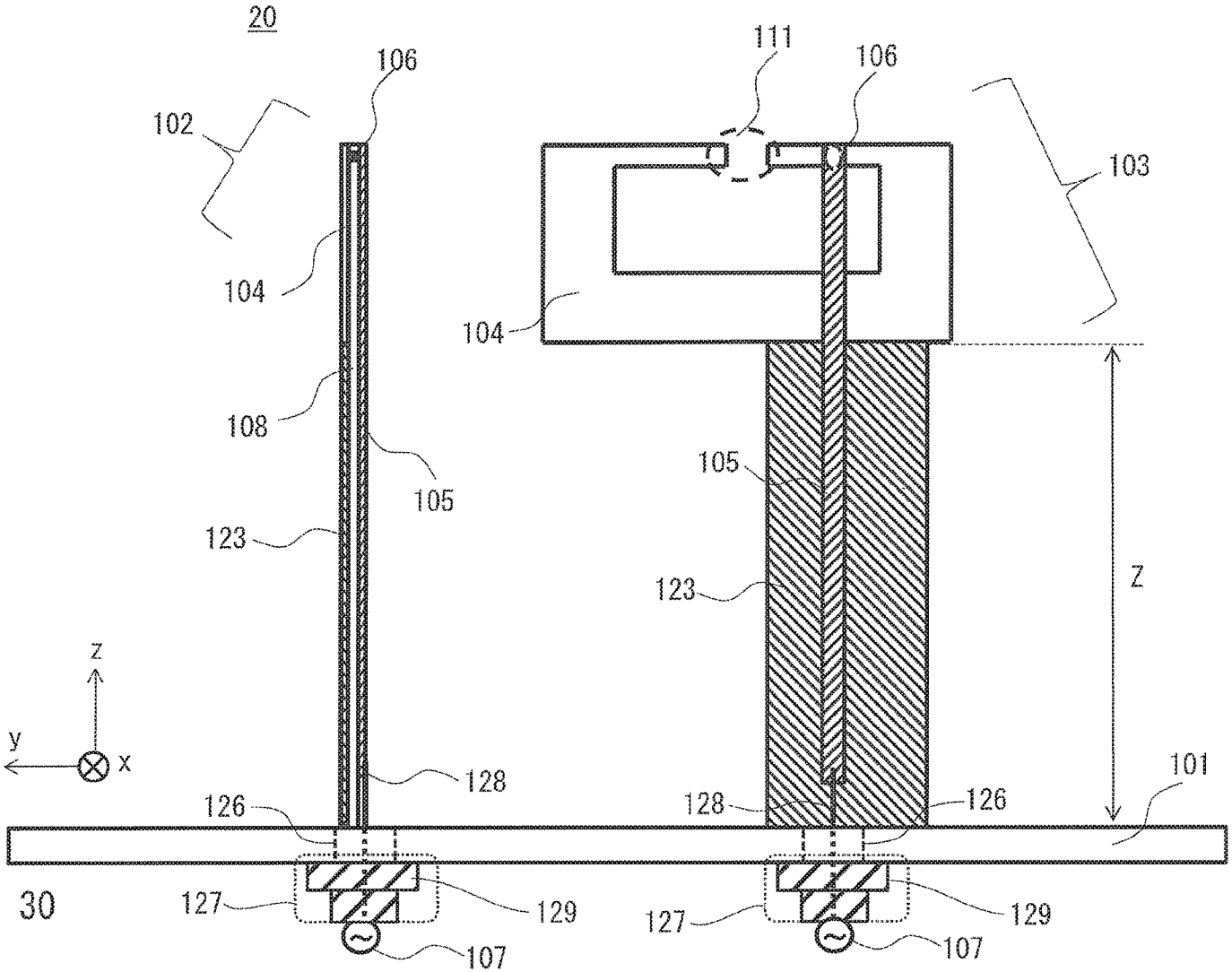
FIG. 30 is a front view of a modified example of the antenna.

Further, as shown in FIGS. 29 and 30, a clearance 126 may be provided in the conductive reflector 101 and a connector 127 may be provided on a rear side (z-axis negative direction side) of the conductive reflector 101. In this case, an external conductor 129 of the connector 127 is electrically connected to the conductive reflector 101. Then a core wire 128 of the connector 127 passes inside the clearance 126, penetrates through the front side (z-axis positive direction side) of the conductive reflector 101, and is electrically connected to the conductor feed line 105 of the antenna elements 102 and 103. Further, the feeding point 107 is capable of electrically exciting a part between the core wire 128 of the connector 127 and the external conductor 129. According to the structure stated above, power can be supplied to the two antenna elements 102 and 103 on the front side of the conductive reflector 101 from the radio communication circuit, a digital circuit or the like arranged on the rear side of the conductive reflector 101, whereby the radio communication apparatus can be formed without greatly affecting the radiation pattern and the radiation efficiency.

Furthermore, in the two antenna elements 102 and 103, similar to the first embodiment, the conductive reflector 101 serves as the short-circuited plane. Therefore, in order to suppress the influence of the antenna elements on the resonance characteristics, as shown in FIG. 24, it is more preferable that the distance Z between the two antenna elements 102 and 103 and the conductive reflector 101 be substantially one quarter of the wavelength when the electromagnetic waves whose frequency is a resonance frequency of the antenna elements travel through a substance that fills the region. Even when the distance Z is not substantially one quarter of the wavelength, this does not affect the fundamental effects of the present invention. Further, the distance Z in the antenna element 102 and the distance Z in the antenna element 103 may be different from each other.

Figure 31:
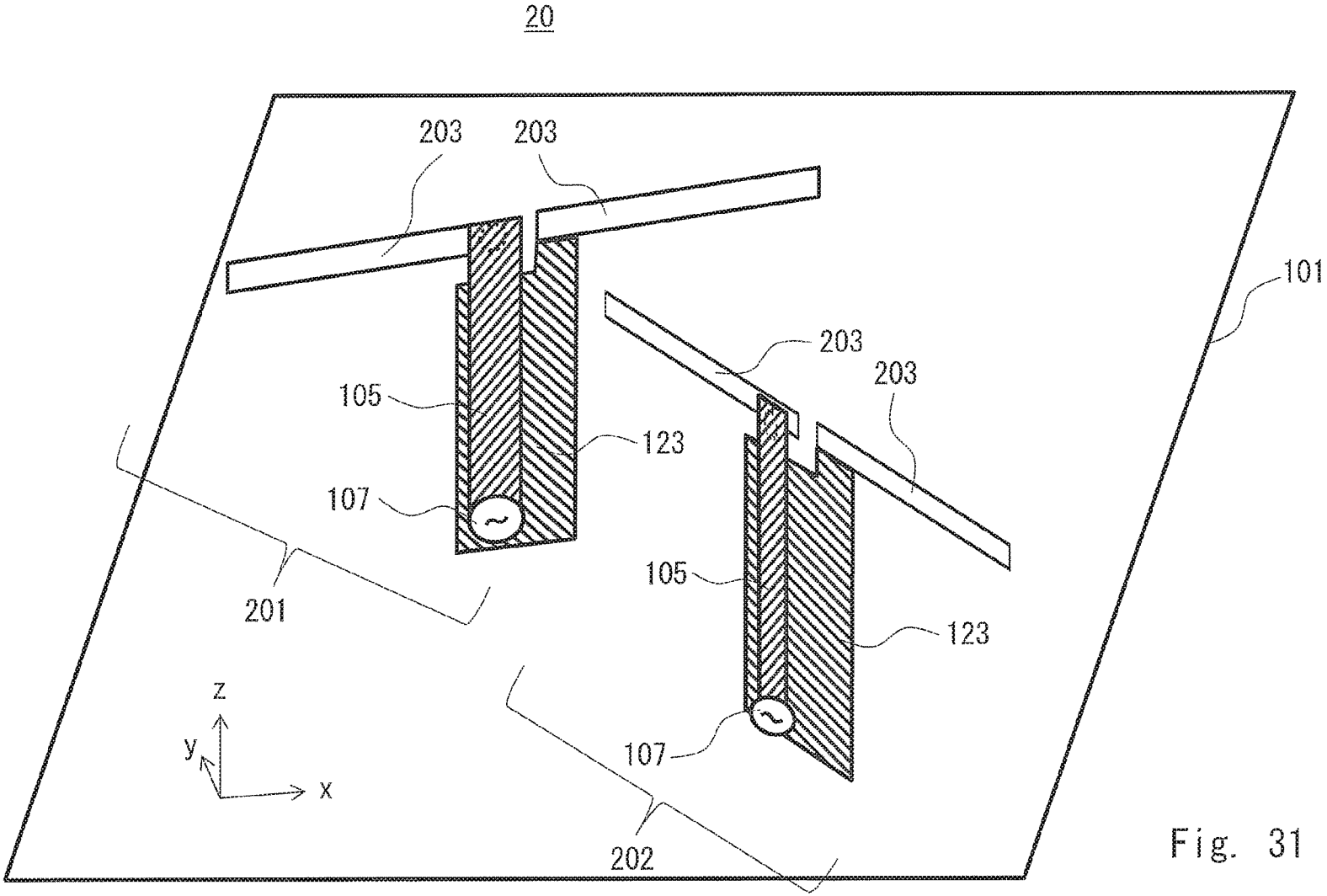
FIG. 31 is a perspective view of a modified example of the antenna.

Further, as described in the first embodiment, it can be regarded that the part about the approximate center of each of the dipole antenna elements is the electrically short-circuited plane at resonance. Therefore, as shown in FIG. 31, even when the dipole antenna elements 201 and 202 are used, by connecting the conductor feed GND part 123 to the approximate center of each of the dipole antenna elements 201 and 202, it is possible to form the transmission line connected to the antenna element without affecting the resonance characteristics. In this case, as shown in FIG. 31, the antenna 20 includes the conductor feed GND part 123 having one end connected to one of two conductor parts of the radiation part 203 and the other end connected to the conductive reflector 101, the conductor feed line 105 that is opposed to the conductor feed GND part 123 and has one end connected to the other one of the two conductor parts of the radiation part 203 and the other end extended toward the conductive reflector 101, and the feeding point 107 that excites the part between one end of the conductor feed line 105 that is extended and the neighboring conductor feed GND part 123, the other structures of the antenna 20 being the same as the structures in the first embodiment as shown in FIG. 22.

As a matter of course, the aforementioned embodiments and the plurality of modified examples described above may be combined within a range in which the contents thereof do not conflict with each other. Moreover, though the functions and the like of each component have been described in detail in the embodiments and the modified examples described above, they may be changed in various ways within a range that satisfies the invention of the present application.

The first and second embodiments have been described above. The embodiments described above have the following characteristics.

(1) As shown in FIG. 1, the antenna 10 includes the conductive reflector 101 and the two antenna elements 102 and 103 (antenna elements) that are arranged to be spaced apart from each other. As shown in FIG. 3, in a projected view on the conductive reflector 101, the longitudinal directions of the two antenna elements 102 and 103 are substantially orthogonal to each other. The end part 110 of the antenna element 103 in the longitudinal direction is positioned at the approximate center 109 (part around the center) of the antenna element 102 in the longitudinal direction.

(2) As shown in FIG. 22, the antenna elements 102 and 103 may be the dipole antenna elements 201 and 202, respectively.

(3) As shown in FIG. 2, each of the antenna elements 102 and 103 includes the C-shaped conductor 104 having the substantially C shape that is formed by cutting out a part of the substantially ring-shaped conductor and the conductor feed line 105 having one end connected to the C-shaped conductor 104. The C-shaped conductor 104 includes the split part 111, which corresponds to the notch formed in the C-shaped conductor 104.

(4) As shown in FIGS. 23 and 24, each of the antenna elements 102 and 103 includes the conductor feed GND part 123 that is arranged so that it is opposed to the conductor feed line 105. The conductor feed GND part 123 has one end connected to the outer edge of the C-shaped conductor 104. The conductor feed GND part 123 has the other end connected to the conductive reflector 101.

(5) As shown in FIG. 24, one end of the conductor feed GND part 123 is connected to the approximate center of the outer edge of the C-shaped conductor 104. In the example shown in FIG. 24, one end of the conductor feed GND part 123 is connected to the approximate center of the outer edge of the C-shaped conductor 104 on the side of the conductive reflector 101.

(6) As shown in FIG. 19, each of the antenna elements 102 and 103 includes at least one auxiliary conductor pattern 118 that is electrically connected to one of the two conductors of the C-shaped conductor 104 opposed to each other in the split part 111 and is opposed to the other one of the two conductors thereof. The auxiliary conductor pattern 118 is opposed to the other conductor in, for example, the thickness direction of the C-shaped conductor 104.

(7) As shown in FIGS. 13 to 15 and 32, the C-shaped conductor 104 is formed with an approximately rectangular flat shape. Each of the antenna elements 102 and 103 includes the conductor radiation part 117 connected to at least one of two outer edges adjacent to the outer edge where the split part 111 is formed among four outer edges of the C-shaped conductor 104. In this embodiment, each of the antenna elements 102 and 103 includes a pair of conductor radiation parts 117 connected to the two respective outer edges adjacent to the outer edge where the split part 111 is formed among the four outer edges of the C-shaped conductor 104.

(8) As shown in FIG. 2, the C-shaped conductor 104 is formed with an approximately rectangular flat shape. The split part 111 is positioned at the approximate center of the outer edge corresponding to a long side among the four outer edges of the C-shaped conductor 104.

(9) As shown in FIG. 5, the antenna array 12 includes the plurality of antennas 10.

(10) As shown in FIG. 4, the radio communication apparatus 11 includes the antenna 10. As shown in FIG. 6, the radio communication apparatus 13 includes the antenna array 12.

(Supplementary Note 1)

An antenna comprising:

a conductive reflector; and two antenna elements that are arranged to be spaced apart from each other, wherein the two antenna elements are arranged so that, in a projected view on the conductive reflector, longitudinal directions of the antenna elements are substantially orthogonal to each other and an approximate center of one of the antenna elements is arranged on a line obtained by extending the other one of the antenna elements in the longitudinal direction.

(Supplementary Note 2)

The antenna according to Supplementary Note 1, wherein the antenna element comprises:

a C-shaped conductor that is continuously formed in a substantially C shape; and a conductor feed line having one end that is electrically connected to a part of the C-shaped conductor, wherein a projection of the conductor feed line on a plane of the C-shaped conductor that forms the substantially C shape partially overlaps an opening formed in the C-shaped conductor.

While the present invention has been described above with reference to the embodiments, the present invention is not limited to the above embodiments. Various changes that may be understood by those skilled in the art may be made on the configurations and the details of the present invention within the scope of the present invention.

This application is based upon and claims the benefit of priority from Japanese Patent Application No. 2014-73195, filed on Mar. 31, 2014, the disclosure of which is incorporated herein in its entirety by reference.

REFERENCE SIGNS LIST

10, 20 ANTENNA
11, 13 RADIO COMMUNICATION APPARATUS
12 ANTENNA ARRAY
101 CONDUCTIVE REFLECTOR
102, 103 ANTENNA ELEMENT
104, 120 C-SHAPED CONDUCTOR
105 CONDUCTOR FEED LINE
106, 119, 121, 125 CONDUCTIVE VIA
107 FEEDING POINT
108 DIELECTRIC LAYER
109 APPROXIMATE CENTER OF ANTENNA ELEMENT
110 END PART OF ANTENNA ELEMENT IN LONGITUDINAL DIRECTION
111, 122 SPLIT PART
112 TRANSMISSION LINE
113 RADIO COMMUNICATION CIRCUIT
114 RADIO COMMUNICATION CIRCUIT UNIT
115 RADOME
116 BRIDGING CONDUCTOR
117 RADIATION PART
118 AUXILIARY CONDUCTOR PATTERN
123, 124 CONDUCTOR FEED GND PART
126 CLEARANCE
127 CONNECTOR
128 CORE WIRE
129 EXTERNAL CONDUCTOR
201, 202 DIPOLE ANTENNA ELEMENT
203 RADIATION PART
Z DISTANCE BETWEEN ANTENNA ELEMENTS 102 AND 103 AND CONDUCTIVE REFLECTOR 101

The invention claimed is:

1. An antenna comprising:

a conductive reflector; and two antenna elements that are arranged to be spaced apart from each other, wherein, in a projected view of the conductive reflector, longitudinal directions of the two antenna elements are substantially orthogonal to each other and an end part of one of the two antenna elements in the longitudinal direction is positioned around the center of the other one of the antenna elements in the longitudinal direction, and the two antenna elements are inverted with respect to the conductive reflector, each of the antenna elements comprises a C-shaped conductor having a substantially C shape, and a conductor feed line having one end connected to the C-shaped conductor, the C-shaped conductor is formed by cutting out a part of a substantially ring-shaped conductor and includes a split part, which corresponds to the cut-out part formed in the C-shaped conductor, the conductor feed line extends across an opening formed inside of the C-shaped conductor, and the conductor feed line has another end extending in a direction substantially orthogonal to the longitudinal direction, wherein the another end of the conductor feed line extends toward the conductive reflector.

2. The antenna according to claim 1, wherein:

each of the antenna elements comprises a conductor feed GND part, the conductor feed GND part has one end that is connected to an outer edge of the C-shaped conductor, and another end extending toward the conductive reflector, and the conductor feed GND part is opposed to the conductor feed line.

3. The antenna according to claim 2, wherein:

the outer edge of the C-shaped conductor extends in a C shape, and the one end of the conductor feed GND part is connected to the approximate center of the outer edge that extends in the C shape.

4. The antenna according to claim 2, wherein the another end of the conductor feed GND part is connected to the conductive reflector.

5. The antenna according to claim 1, wherein:

each of the antenna elements comprises at least one auxiliary conductor that is electrically connected to one of two conductors of the C-shaped conductor that are opposed to each other in the split part and is opposed to the other one of the two conductors of the C-shaped conductor.

6. The antenna according to claim 1, wherein:

the C-shaped conductor is formed with an approximately rectangular flat shape, and each of the antenna elements comprises a conductor radiation part connected to at least one of two outer edges that are adjacent to an outer edge where the split part is formed among four outer edges of the C-shaped conductor.

7. The antenna according to claim 1, wherein:

the C-shaped conductor is formed with an approximately rectangular flat shape, and the split part is positioned at the approximate center of the outer edge corresponding to a long side among the four outer edges of the C-shaped conductor.

8. An antenna array comprising a plurality of antennas according to claim 1.

9. A radio communication apparatus comprising the antenna array according to claim 8.

10. A radio communication apparatus comprising the antenna according to claim 1.

* * * * *